US012571551B2

(12) United States Patent
Edström et al.

(10) Patent No.: US 12,571,551 B2
(45) Date of Patent: Mar. 10, 2026

(54) SYSTEM AND METHOD FOR CONTROLLING TEMPERATURE AND WATER CONTENT OF AN AIRSTREAM

(71) Applicant: AIRWATERGREEN GROUP AB, Uppsala (SE)

(72) Inventors: Fredrik Edström, Uppsala (SE); Per Dahlbäck, Vänge (SE); Jonas Högström, Storvreta (SE)

(73) Assignee: AIRWATERGREEN GROUP AB, Uppsala (SE)

( * ) Notice: Subject to any disclaimer, the term of this patent is extended or adjusted under 35 U.S.C. 154(b) by 371 days.

(21) Appl. No.: 18/284,098

(22) PCT Filed: Mar. 21, 2022

(86) PCT No.: PCT/SE2022/050266
§ 371 (c)(1),
(2) Date: Sep. 26, 2023

(87) PCT Pub. No.: WO2022/203573
PCT Pub. Date: Sep. 29, 2022

(65) Prior Publication Data

US 2024/0167708 A1 May 23, 2024

(30) Foreign Application Priority Data

Mar. 26, 2021 (SE) ..... 2150370-1

(51) Int. Cl.
*F24F 11/00* (2018.01)
*F24F 3/14* (2006.01)
(Continued)

(52) U.S. Cl.
CPC ..... *F24F 11/0008* (2013.01); *F24F 3/1405* (2013.01); *F24F 11/84* (2018.01); *F24F 2110/10* (2018.01); *F24F 2110/20* (2018.01)

(58) Field of Classification Search
CPC ..... F24F 11/0008; F24F 3/1405; F24F 11/84; F24F 2110/10; F24F 2110/20;
(Continued)

(56) References Cited

U.S. PATENT DOCUMENTS 6,966,364 B1 11/2005 Babikian et al.
10,222,078 B2 3/2019 Ma et al.
(Continued)

FOREIGN PATENT DOCUMENTS

EP 1887288 A1 2/2008
WO 00/47933 A2 8/2000
(Continued)

*Primary Examiner* — Eric J Yoon
(74) *Attorney, Agent, or Firm* — Dilworth & Barrese, LLP.; Michael J. Musella, Esq.

(57) ABSTRACT

The present invention relates to a computer implemented method for controlling temperature and humidity of an air in stream, the method comprising receiving parameters indicative of a temperature and water content of an airstream in a downstream section and of a temperature and water content of a medium in the system, and further determining in processing circuitry a desired temperature change and desired water content change of the first medium as a first function f1 based on the received parameters and also based on a second function that defines a relationship between the air temperature and the air water content as co-dependent variables; and also generating a first and second control signal configured to apply the desired temperature change and the desired water content change to the first medium. The invention also relates to a corresponding system.

15 Claims, 8 Drawing Sheets

(51) Int. Cl.
*F24F 11/84* (2018.01)
*F24F 110/10* (2018.01)
*F24F 110/20* (2018.01)

(58) Field of Classification Search
CPC .. F24F 2003/1435; F24F 5/0014; F24F 11/83; F24F 3/1417
See application file for complete search history.

(56) References Cited

U.S. PATENT DOCUMENTS

| | | | | |
|---|---|---|---|---|
| 2014/0260373 | A1* | 9/2014 | Gerber | F24F 11/30 62/271 |
| 2015/0068225 | A1 | 3/2015 | Laughman et al. | |
| 2019/0353385 | A1 | 11/2019 | Aucoin et al. | |
| 2020/0269184 | A1 | 8/2020 | Friesen et al. | |
| 2020/0408425 | A1 | 12/2020 | Zchori | |
| 2021/0298246 | A1* | 9/2021 | Lefers | F24F 5/0035 |

FOREIGN PATENT DOCUMENTS

| | | | |
|---|---|---|---|
| WO | 2015/045609 | A1 | 4/2015 |
| WO | 2016/085894 | A2 | 6/2016 |
| WO | 2018/191807 | A1 | 10/2018 |

* cited by examiner

Fig 6

$$P = \alpha(v)A(T_s - T_a) \tag{1}$$

$$q = \beta(v)A(P_{vs} - P_{va}) \tag{2}$$

$$P_{va} = \frac{RH_a}{100} 10.0^{(A_m - \frac{B_m}{C_m + T_a})} \tag{3}$$

$$P_{vs} = w_a(w_c) 10.0^{(A_m - \frac{B_m}{C_m + T_s})} \tag{4}$$

$$P_{Ev} = E_v(T_a)q \tag{5}$$

$$\frac{T_s}{dt} = \frac{-P_{Ev} - P}{C_{ps} m_s} \tag{6}$$

$$\frac{T_a}{dt} = \frac{P_{Ev} + P}{C_{pa} m_a} \tag{7}$$

$$\frac{x_a}{dt} = \frac{q}{m_a} \tag{8}$$

$$\frac{m_w}{dt} = -q \tag{9}$$

SYSTEM AND METHOD FOR CONTROLLING TEMPERATURE AND WATER CONTENT OF AN AIRSTREAM

TECHNICAL FIELD

The present invention relates to a system for controlling temperature and water content of an airstream using a contact device for transferring thermal energy and water vapor between a first medium and the air stream. The invention also relates to a computer implemented method for controlling temperature and water content of the airstream.

BACKGROUND

One of the most critical challenges today is climate change. Furthermore, buildings account for about 40% of the total energy consumption in the world, largely due to climate control in indoor spaces.

Generally, when providing climate control the parameters of air that are controlled are the temperature and the relative humidity, i.e. the water content of the air. There are various prior art systems that are known to be able to change temperature and water content of indoor air but they are generally expensive both in terms of purchasing and installing them and also in terms of the amount of energy that they consume when they are in operation. In many parts of the world, climate control is needed at all times due to temperatures being outside a desired range for buildings such as homes or offices. Also, the air may be too humid or may have a rapidly changing humidity over time that must be controlled.

However, the known systems suffer from serious drawbacks. In some cases, they are unable to control the temperature and water content of the air in both directions, i.e. to both increase and decrease the temperature and the relative humidity of the air. This renders their use limited, especially in regions where ambient conditions change over time so that different modes of operations are required in order to achieve a stable indoor environment. Also, many systems operate by controlling the humidity and the temperature in two separate steps, so that humidity of the air is controlled in a first step and temperature in a second. This is highly inefficient, since controlling humidity generally takes place by cooling the air so that water is condensed, followed by a re-heating of the air to reach the desired indoor temperature. It is also not possible to increase the humidity in this way, rendering the use of such systems limited.

Some prior art systems that are related to this technical field are U.S. Pat. No. 9,518,765B2 (Laughman), EP2971993B1 (Gerber) and JPH11132593A (Tanimotor).

The known document U.S. Pat. No. 10,222,078B2 (Ma) is aware of these problems and attempt to overcome them by changing the relative humidity and the temperature in a single step to avoid cooling and re-heating of the air. However, U.S. Pat. No. 10,222,078B2 (Ma) does not provide any description of how the problems could be solved and is also vague regarding how the system actually operates. There are no known inputs to the system that could provide information of any parameters inside or outside the system and also no real teaching of how the problem is solved. The skilled person is therefore not able to actually construct the system shown by U.S. Pat. No. 10,222,078B2 (Ma) and also not of operating any known system in order to achieve an energy efficient and reliable climate control that controls both temperature and humidity or water content of indoor air.

There is therefore a need for an improved system and method that overcome these drawbacks and provide an improved temperature and water content control for an air stream.

SUMMARY

The object of the present invention is to eliminate or at least to minimize the problems discussed above. This is achieved by a system and computer implemented method for controlling temperature and water content of an air stream according to the appended independent claims.

The system according to the present invention comprises

- a contact device for transferring thermal energy and water vapor between a medium and an air stream flowing through the contact device, the contact device being configured to allow a contact between the medium and the air stream in which thermal energy and water vapor is transferred,
- a first control device for controlling water content of the medium, and
- a second control device for controlling temperature of the medium,
- wherein the contact device, the first control device and the second control device are connected such that the medium is able to flow in a loop comprising the contact device, the first control device, and the second control device.

The system further comprises processing circuitry configured to control the first control device and the second control device, and the system also comprises

- a first sensor configured to measure a medium water content parameter, $wc_{medium}$, of the medium and to send signals indicative of the medium water content parameter to the processing circuitry, said medium water content parameter being a parameter indicative of an amount of water in the medium,
- a second sensor configured to measure a medium temperature of the medium, $T_{medium}$, and to send signals indicative of the temperature to the processing circuitry,
- a third sensor configured to measure an air temperature of the air stream, $T_{air}$, and to send signals indicative of the temperature to the processing circuitry, and
- a fourth sensor configured to measure an air water content parameter, $wc_{air}$ of the air stream and to send signals indicative of the air water content parameter to the processing circuitry, said air water content parameter being a parameter indicative of an amount of water in the air stream,
- wherein said third sensor and said fourth sensor are configured to measure air temperature and air water content in a downstream section, said downstream section being a section that the air stream passes after flowing through the contact device.

Also, the processing circuitry is configured to control air temperature and air water content of the air stream passing through the contact device by

- receiving, from the first sensor, a first input signal comprising the medium water content parameter, $wc_{medium}$,
- receiving, from the second sensor, a second input signal comprising the measured medium temperature, $T_{medium}$,
- receiving, from the third sensor, a third input signal, comprising the measured air temperature, $T_{air}$, receiving, from the fourth sensor, a fourth input signal comprising the measured air water content parameter, $wc_{air}$, determining, based on the received parameters, a desired temperature change, $T_{change}$, and desired water content change, $wc_{change}$ of the medium as a first function $f_1$:

$$(T_{change}, wc_{change}) = f_1(T_{medium}, wc_{medium}, T_{air}, wc_{air}, f_2(T_{air}, wc_{air}))$$

wherein the second function $f_2(T_{air}, wc_{air})$ defines a relationship between the air temperature, $T_{air}$, and the air water content, $wc_{air}$, as co-dependent variables such that a change in the value of one of the air temperature, $T_{air}$, and the air water content, $wc_{air}$, affects the value of the other, and wherein the desired temperature change, $T_{change}$ and the desired water content change, $wc_{change}$ are determined such that the air stream flowing through the contact device approaches a predetermined temperature setpoint, $T_{set}$, and a predetermined water content setpoint, $wc_{set}$, through contact with the medium in the contact device.

Furthermore, the processing circuitry is configured to generate a first control signal which is configured to cause the first control device to apply the water content change, $wc_{change}$, to the medium such that the medium water content changes from the value of the medium water content parameter, $wc_{medium}$, by the desired water content change, $f(wc_{medium}, wc_{change})$, and to generate a second control signal which is configured to cause the second control device to apply the temperature change, $T_{change}$ to the medium such that the medium temperature changes from the measured medium temperature, $T_{medium}$, by the desired temperature change, $f(T_{medium}, T_{change})$.

The system has the advantage of being configured to adjust both temperature and water content of the air stream simultaneously in an energy efficient and thereby cost-efficient way. It is a particular benefit that the processing circuitry is configured to use sensor input as well as a second function that defines a relationship between temperature and water content so that the desired temperature change and water content change of the medium may be determined in order to bring the temperature and water content values of the air stream towards the setpoint values.

Suitably, the processing circuitry is further configured to repeatedly receive the first input signal, the second input signal, the third input signal and the fourth input signal update the first function $f_1$, and update the first control signal and second control signal based on said updated first function $f_1$.

Thereby, the processing circuitry is able to use feedback to repeatedly apply the desired temperature change and desired water content change to the medium in order for the air water content and the air temperature to approach the setpoint values.

Also, the system is suitably configured to transmit the first control signal to the first control device and to change the medium water content in the first control device in response to said first control signal. Also, the system is suitably configured to transmit the second control signal to the second control device and to change the medium temperature in the second control device in response to the second control signal. Thereby, the determined temperature change and water content change can be applied to the medium in an efficient and convenient way in order to control the temperature and water content of the air stream.

In some embodiments, the system may also comprise a fifth sensor configured to measure an upstream air temperature of the air stream, $T_{upstream}$, and to send signals indicative of the temperature to the processing circuitry, and a sixth sensor configured to measure an upstream air water content parameter, $wc_{upstream}$, of the air stream and to send signals indicative of the upstream air water content to the processing circuitry, said upstream air water content parameter being a parameter indicative of an amount of water in the air stream, wherein said fifth sensor and said sixth sensor are configured to measure upstream air temperature and upstream air water content in an upstream section, said upstream section being a section that the air stream passes before flowing through the contact device.

The processing circuitry is in such embodiments also configured to receive, from the fifth sensor, a fifth input signal, comprising the measured upstream air temperature, $T_{upstream}$, receive, from the sixth sensor, a sixth input signal comprising the measured upstream air water content, $wc_{upstream}$, and to determine the first function $f_1$:

$$(T_{change}, wc_{change}) = f_1(T_{medium}, wc_{medium}, T_{air}, wc_{air}, f_2(T_{air}, wc_{air}), T_{upstream}, wc_{upstream}).$$

Thereby, input values of the air stream in the form of current values for the temperature and water content may be taken into account so that the changes determined for the medium are even more suitable for making the air stream approach the setpoints in a quick and energy efficient way.

Suitably, the processing circuitry may further be configured to determine the first function $f_1$ based on the received parameters and also on at least one contact device parameter, cd, of the contact device, as:

$$(T_{change}, wc_{change}) = f_1(T_{medium}, wc_{medium}, T_{air}, wc_{air}, f_2(T_{air}, wc_{air}), cd)$$

Thereby, properties of the contact device may also be taken into account in order to determine a change of the medium that is able to bring the air stream towards the setpoints.

Suitably, one contact device parameter, cd, is a mass flow of the air stream or of the medium through the contact device. Also, one contact device parameter, cd, may be a back pressure. By using one or both of these contact device parameters, determining the change of the medium that is able to bring the air stream towards the setpoints is improved.

Also, the first control device may suitably comprise a buffer that in turn comprises a volume of the medium. Changing the medium water content then suitably comprises adding water to the buffer and/or removing water from the buffer by regenerating a portion of the volume. Thereby, the water content of the medium can be changed in a convenient way. By adjusting a quantity of the medium that is regenerated, the water content may be lowered at a desired rate. Conversely, the water content may be increased at a desired rate by adjusting a volume of water that is added to the buffer. Suitably, the second control device comprises a heat exchanger. Thereby, the temperature of the medium may be changed in a convenient and cost and energy efficient way as the medium passes through the heat exchanger.

Also, the first sensor is suitably arranged to measure the water content parameter of the medium, $wc_{medium}$, in the loop downstream of the second control device but upstream of the contact device. Thereby, the water content of the medium immediately before it is brought into contact with the air stream is measured. This also gives the information of the water content of the medium downstream of the first control device so that the result of any newly applied changes to the water content are measured.

Furthermore, the second sensor is suitably arranged to measure the temperature of the medium, $T_{medium}$, in the loop downstream of the second control device but upstream of the contact device. Thereby, the temperature of the medium after passing the second control device is measured so that temperature of the medium immediately before coming into contact with the air stream in the contact device is known.

Also, the system may suitably comprise at least one additional sensor configured to measure the temperature of the medium, $T_{medium}$, or the water content parameter of the medium, $wc_{medium}$, wherein the additional sensor is configured to measure the medium temperature, $T_{medium}$, or the water content parameter of the medium, $wc_{medium}$, in another part of the loop then the first sensor or the second sensor. Thereby, the water content and/or temperature of the medium may be measured also immediately downstream of the contact device or between the first control device and the second control device. It is particularly interesting to measure the temperature and/or water content before the medium reaches the first control device, since this gives the information of how the interaction between the medium and the air stream in the contact device has changed these parameters of the medium. These changes may be determined by comparing the water content and/or temperature measured by the first and/or second sensor with the water content and/or temperature measured by the additional sensor and gives information about how much thermal energy has passed between the medium and the air stream and/or how much water vapor has passed between them.

The processing circuitry may further be configured to determine the first function $f_1$, using at least one proportional-integral-derivative controller, PID. This is a convenient and highly suitable way of determining the first function so that temperature and water content of the medium are controlled in an efficient way. In some embodiments, one PID may be used to determine the desired temperature change and the second control signal whereas another PID may be used to determine the desired water content change and the first control signal. If more than one PID is used, they all suitably have access to the second function and are suitably also configured to communicate with each other so that information may be transmitted between them.

In some embodiments, the processing circuitry may instead be configured to determine the first function $f_1$, using a linear-quadratic regulator, LQR. The LQR is an optimal state-feedback controller, intended to minimize the cost described by a quadratic function. This implies a minimal controller effort while simultaneously eliminating the error which is advantageous in providing a reliable and convenient way of determining the first function and the first and second control signals.

Also, in some embodiments the processing circuitry is instead configured to determine the first function $f_1$, using model predictive control, MPC. The predictive element of the controller is able to forecast change in the system operating point and prime the system to eliminate disturbances prior to the disturbance event. This is advantageous in providing an efficient control of temperature and water content of the air stream while at the same time minimizing the effects of disturbances that may occur.

Suitably, the contact device is an evaporator pad. Thereby, contact between the medium and the air stream may be achieved in a convenient and reliable way, while also allowing for a cost-efficient contact device with surface maximizing properties so that the transfer of thermal energy and water vapor may take place in an efficient way. Evaporator pads also have the advantage of capturing particles from the air stream so that the air is filtered and rendered clean.

Alternatively, the contact device may be a liquid to air membrane energy exchanger, LAMEE. This is advantageous in providing efficient transfer of thermal energy and water vapor while at the same time preventing drops of the medium from entering the air stream and being removed from the contact device through the air outlet.

Suitably, the medium is a salt such as Calcium Chloride, $CaCl_2$, Magnesium Chloride, $MgCl_2$, or Potassium Sulfate, $K_2SO_4$. This is advantageous in ensuring excellent transfer of thermal energy and of water vapor to and from the air stream.

Also, the first sensor is suitably configured to measure the medium water content parameter, $wc_{medium}$, by measuring a vapor pressure of the medium. Thereby, the water content may be determined in a convenient way.

The present invention also comprises a computer implemented method for controlling temperature and humidity of an air stream in a system comprising a contact device for transferring thermal energy and water vapor between a medium and an air stream flowing through the contact device, the contact device being configured to allow a contact between the medium and the air stream in which thermal energy and water vapor is transferred; a first control device for controlling water content of the medium; a second control device for controlling temperature of the medium; and processing circuitry configured to control the first control device and the second control device, wherein the contact device, the first control device and the second control device are connected such that the medium is able to flow in a loop comprising the contact device, the first control device, and the second control device. The method comprises:

receiving, in the processing circuitry, a first input signal from a first sensor, said first input signal comprising a measured medium water content parameter, $wc_{medium}$, indicative of the water content of a medium, receiving, in the processing circuitry, a second input signal from a second sensor, said second input signal comprising a measured medium temperature, $T_{medium}$, indicative of the temperature of the medium, receiving, in the processing circuitry, a third input signal from a third sensor, said third input signal comprising a measured air temperature, $T_{air}$, indicative of a temperature of the air stream in a downstream section of the system, said downstream section being a section that the air stream passes after flowing through the contact device, receiving, in the processing circuitry, a fourth input signal from a fourth sensor, said fourth input signal comprising a measured air water content parameter $wc_{air}$, indicative of an amount of water in the air stream in the downstream section of the system, determining, using the processing circuitry, based on the received parameters, a desired temperature change, $T_{change}$, and desired water content change, $wc_{change}$, of the medium as a first function $f_1$:

$$(T_{change}, wc_{change}) = f_1(T_{medium}, wc_{medium}, T_{air}, wc_{air}, f_2(T_{air}, wc_{air}))$$

wherein the second function $f_2(T_{air}, wc_{air})$ defines a relationship between the air temperature, $T_{air}$, and the air water content, $wc_{air}$, as co-dependent variables, such that a change in the value of one of the air temperature, $T_{air}$, and the air water content, $wc_{air}$, affects the value of the other, and wherein the desired temperature change, $T_{change}$ and the desired water content change, $wc_{change}$ are determined such that the air stream flowing through a contact device approaches a predetermined temperature setpoint, $T_{set}$, and a predetermined water content setpoint, $wc_{set}$, through contact with the medium in the contact device.

Furthermore, the method comprises:

generating, using the processing circuitry, a first control signal, $C_1$, which is configured to cause the first control device to apply the water content change, $wc_{change}$, to the medium such that the medium water content changes from the value of the medium water content parameter, $wc_{medium}$, by the desired water content change, $f(wc_{medium}, wc_{change})$, and generating, using the processing circuitry, a second control signal, $C_2$, which is configured to cause the second control device to apply the temperature change, $T_{change}$ to the medium such that the medium temperature changes from the measured medium temperature, $T_{medium}$, by the desired temperature change, $f(T_{medium}, T_{change})$.

In some embodiments, the method also comprises repeatedly receiving, in processing circuitry, the first input signal, the second input signal, the third input signal and the fourth input signal updating, using processing circuitry, the first function $f_1$, and updating, using processing circuitry, the first control signal and second control signal based on said updated first function $f_1$.

Also, in some embodiments the method comprises transmitting the first control signal to a first control device, said first control device being configured to change the medium water content of the medium, and changing the medium water content in response to said first control signal.

Furthermore, the method suitably may comprise transmitting the second control signal to a second control device, said second control device being configured to change the medium temperature of the medium, and changing the medium temperature in response to said second control signal.

Also, the method may comprise:

receiving, in processing circuitry, a fifth input signal from a fifth sensor configured to measure an upstream air temperature of the air stream, $T_{upstream}$, said fifth input signal comprising the measured upstream air temperature, $T_{upstream}$, receiving, in processing circuitry, a sixth input signal from a sixth sensor configured to measure an upstream air water content parameter, $wc_{upstream}$, of the air stream, said sixth input signal comprising the measured upstream air water content parameter, $wc_{upstream}$, and determining the first function $f_1$ based on the received parameters as $$(T_{change}, wc_{change}) = f_1(T_{medium}, wc_{medium}, T_{air}, wc_{air}, f_2(T_{air}, wc_{air}), T_{upstream}, wc_{upstream}).$$

In some embodiments, the method also comprises determining the first function $f_1$ based on the received parameters and on at least one predetermined contact device parameter, cd, of a contact device as $$(T_{change}, wc_{change}) = f_1(T_{medium}, wc_{medium}, T_{air}, wc_{air}, f_2(T_{air}, wc_{air}), cd)$$

Suitably, the method may comprise determining the first function $f_1$, using at least one proportional-integral-derivative controller, PID.

Alternatively, the method instead comprises determining the first function $f_1$, using a linear-quadratic regulator, LQR.

In some embodiments, the method instead comprises determining the first function $f_1$, using model predictive control, MPC.

These various features of the method achieve the advantages noted above with reference to corresponding embodiments of the inventive system.

Many additional benefits and advantages of the present invention will be readily understood by the skilled person in view of the detailed description below.

DRAWINGS

The invention will now be described in more detail with reference to the appended drawings, wherein FIG. 1 discloses schematically a system according to a first embodiment of the present invention;

FIG. 2 discloses schematically a system according to a second embodiment of the invention;

FIG. 3 discloses schematically input and output of processing circuitry according to the invention;

Figure 7:
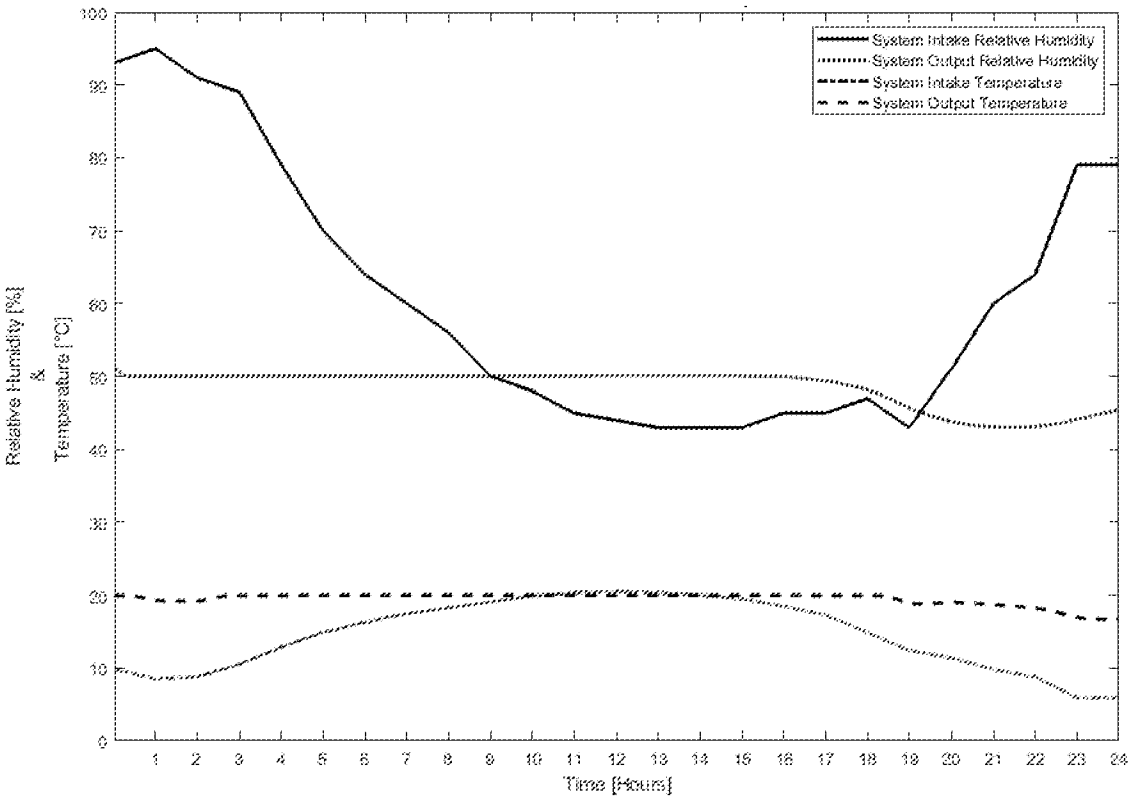
Figure 8:
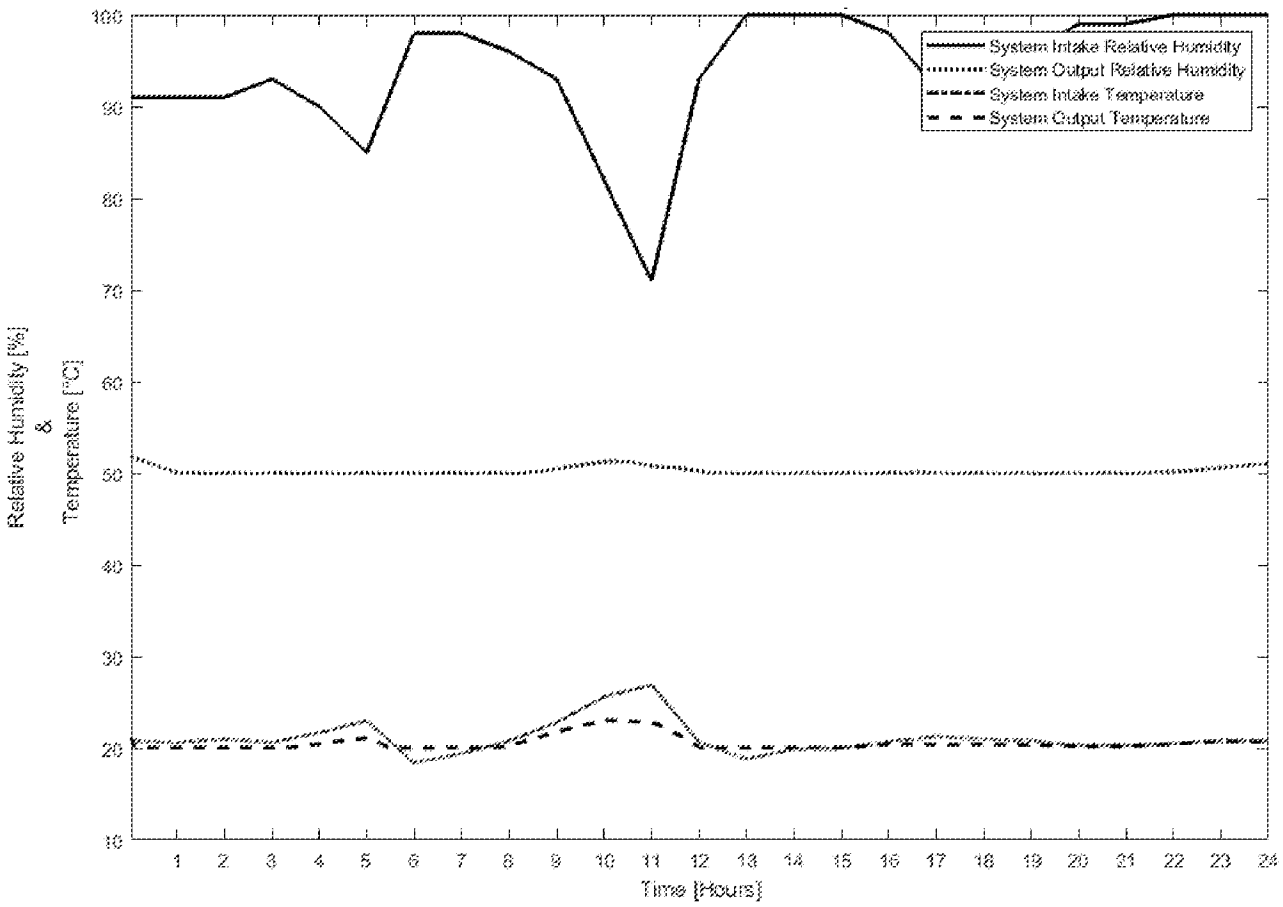

FIG. 6 discloses equations that form the second function in an embodiment of the invention;

FIG. 7 discloses a first graph that show results of Example 1 of the use case examples; and FIG. 8 discloses a second graph that show results of Example 2 of the use case examples.

All the figures are schematic, not necessarily to scale, and generally only show parts which are necessary in order to elucidate the respective embodiments, whereas other parts may be omitted or merely suggested. Any reference number appearing in multiple drawings refers to the same object or feature throughout the drawings, unless otherwise indicated.

DETAILED DESCRIPTION

Introduction

Aspects of the present disclosure will be described more fully hereinafter with reference to the accompanying drawings. The methods and systems disclosed herein can, however, be realized in many different forms and should not be construed as being limited to the aspects set forth herein. Like numbers in the drawings refer to like elements throughout.

The terminology used herein is for the purpose of describing particular aspects of the disclosure only and is not intended to limit the invention. As used herein, the singular forms "a", "an" and "the" are intended to include the plural forms as well, unless the context clearly indicates otherwise.

Embodiments presented herein may be used for controlling temperature and water content of an air stream in any real world environment, and there are numerous applications that can benefit from the solutions presented herein. However, the inventors envisage that the greatest advantages of the herein presented embodiments will be obtained in climate control systems for indoor spaces where temperature and humidity or water content of an air stream are to be controlled in order to reach setpoint values. An important realization that serves as a foundation for the present invention is that temperature and water content of a medium such as air are co-dependent variables where a change in the value of one variable also causes a change in the value of the other. Changing the temperature of a medium such as an air stream by heating or cooling will affect the relative humidity of the air stream, whereas changing the water content of the air by humidifying or dehumidifying is an endothermic or exothermic process that in turn affects the temperature. By determining a desired temperature and water content of a medium according to embodiments described herein based both on measured parameters and on a second function that defines the relationship between temperature and water content of the air, control of these parameters is greatly improved as compared with prior art solutions.

The method, system and computer program product embodiments disclosed herein can be used in any environment and can be adapted to a specific purpose by the system being configured to measure desired parameters in various parts of the system and using such measurements as input, and also by the processing circuitry determining the first function based on such input and based on properties of the system, and any other input data provided into the method, system and computer program product. Thereby, the disclosed solution can be highly personalized and adapted to contribute to any suitable purpose that requires control of temperature and water content of an air stream.

When used herein, the term "water content" is to be understood as indicating an amount of water present in a fluid such as a gas or a liquid. The water content is to be understood as an amount of water molecules present in the fluid.

A water content parameter thus refers to a parameter of the fluid that indicates a presence of water molecules in the fluid. For a gas such as air, the water content parameter may be a relative humidity expressed as a percentage, but it may alternatively be another property that can be measured and that is able to give information regarding water content in the fluid. For a liquid such as the medium used in the inventive system, the water content parameter may be a vapor pressure of the liquid taken anywhere in the system, but it may alternatively be another property that can be measured and that is able to give information regarding water content in the liquid. Examples of such properties include a density or a conductivity of the liquid. It is also to be noted that regardless of the property that is measured, the processing circuitry may be configured to perform any operations for converting the measurement into any desired form that is suitable for further processing in the system in order to determine the first function.

The term "operatively connected" is to be understood as one component being connected to another in such a way that one of them may affect the other in some way or that a substance or a signal may pass from one to the other. Thus, an operative connection may comprise a conduit, or a wire connection in which an electrical current may flow, but it may alternatively be a wireless connection in which a transmitter in one component may send a signal that is received by a received in the other.

When the term "parameter" is used herein, this is to be understood both as a property that in itself can be detected and/or measured such as a temperature or a temperature value and also as a property that can be determined based on a detection and/or measurement, such as a water content that may be determined based on a measured relative humidity or a measured vapor pressure. A "parameter" is also to be understood as a known property and/or a measured or detected and/or determined property. An example of a known contact device parameter that may be given by a manufacturer of the contact device is as an angle of inclination of flutes in a pad of the contact device. An example of a measured or detected parameter is a thickness of a pad, and an example of a parameter that is determined based on a measured or detected parameter is a contact device parameter a that is a function of an air velocity in the contact device and that may be determined based on a measurement of said air velocity. For ease of understanding, the system architecture is first described, followed by method embodiments and further embodiments enabling the invention that are described in more detail. Thereafter, a number of non-limiting purposes or applications where the present invention is highly useful are described in the section Use case examples.

System Architecture

Figure 1:
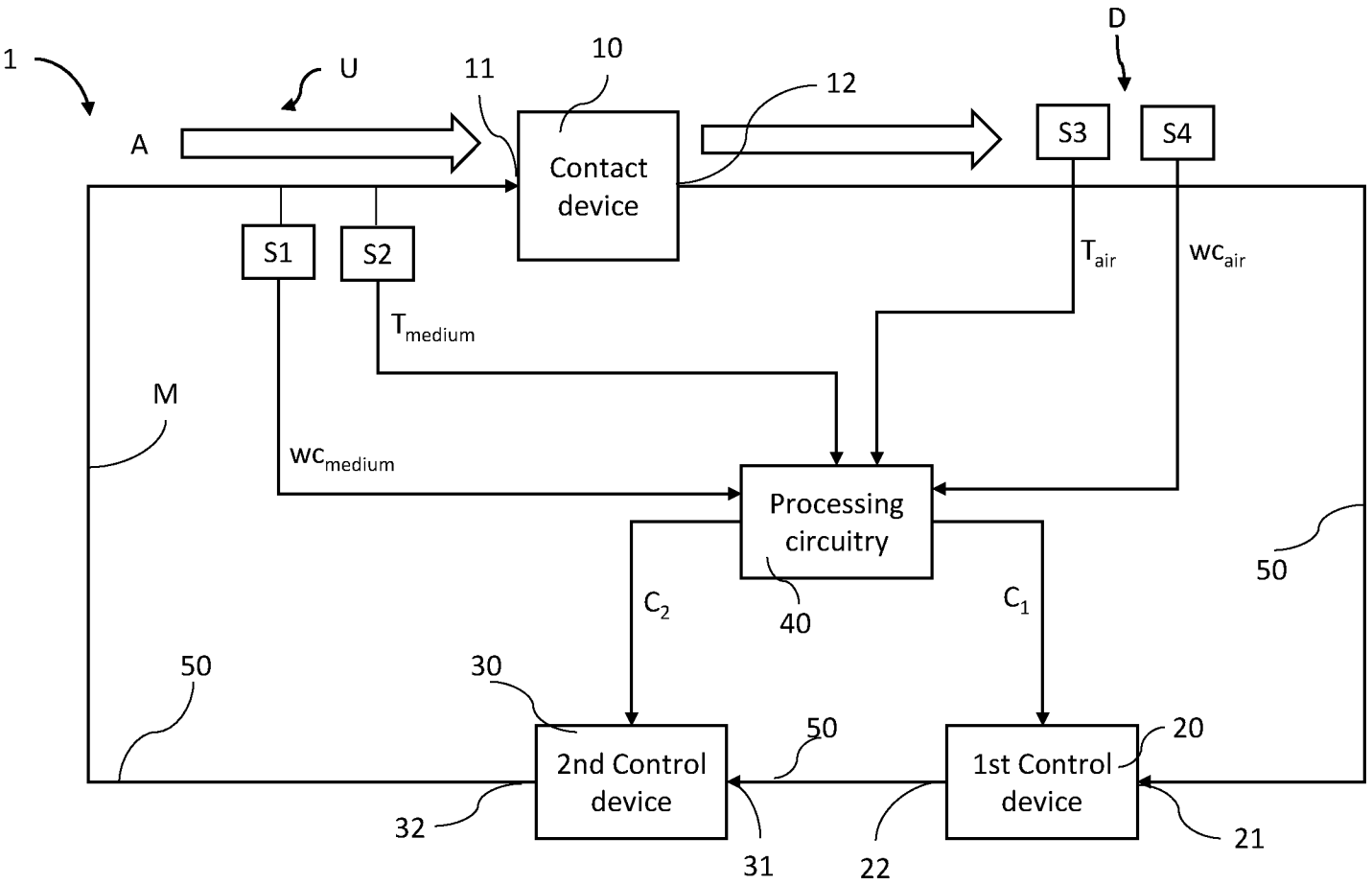

FIG. 1 discloses a system 1 for controlling temperature and water content of an air stream, comprising a contact device 10 through which an air stream A passes in order to come into contact with a medium M that flows in the system 1. In the contact device 10, thermal energy and water vapor is transferred between the air stream A and the medium M and this serves to control the temperature of the air stream A in such a way that a temperature setpoint, $T_{set}$, and a water content setpoint, $wc_{set}$, is approached or preferably reached or maintained. The contact device 10 is configured to enable a contact between the medium and the air stream and this is achieved by the contact device comprising the flow of the medium M and conduits or passages for the air stream A arranged such that the air stream A comes into contact with the medium M such that thermal energy and water vapor may pass from the air stream A to the medium M and from the medium M to the air stream A.

The air flow A is transported to the contact device 10 in any suitable way including providing a conduit that is configured to transport the air flow A to the contact device 10 or by placing the contact device 10 in a space such as a room where air may circulate or move in order to form the air flow A. In some embodiments, mechanical ventilation in the form of a fan or the like may be provided for creating a steady air flow A to the contact device 10, but in other embodiments a natural ventilation may instead be used where air moves through the space or conduit in a passive flow.

The medium M is in the first embodiment a salt that has suitable properties for serving as a medium M and transferring thermal energy and water vapor to and from the air stream A. Examples or suitable media are Calcium Chloride ($CaCl_2$), Magnesium Chloride ($MgCl_2$), and Potassium Sulfate ($K_2SO_4$) that are each highly suitable for use with the present invention. Other salts that would also be very suitable are Sodium Formate (NaCOOH), Potassium Acetate, ($KC_2H_3O_2$), Potassium Formate (KCOOH), Potassium hydroxide (KOH), Lithium Chloride (LiCl), and Magnesium nitrate ($Mg(NO_3)_2$). However, in some embodiments other media could be suitable as long as they are able to transport thermal energy and water and to transfer thermal energy and water vapor to and from the air stream A.

The contact device 10 may be an evaporative pad or a liquid to air membrane energy exchanger, LAMEE, as will be described in the use case examples further below, and optionally the contact device 10 may also be of any other type as long as it enables a thermal contact and a mass transport contact between the air stream A and the medium M so that thermal energy and water molecules in the form of water vapor may be transmitted from one to the other.

In the contact device 10, the air stream A in this preferred embodiment flows perpendicularly to the medium M, i.e. with a flow of the air stream A that is at a 90° angle to a flow of the medium M. The angle between the flow of the air stream A and the flow of the medium M may differ slightly and still be considered perpendicular, so that the term "perpendicular" in this context is to be understood as an angle of 80-100°, preferably 85-95° and even more preferably 87-93°. In other embodiments, the flow of the air stream A and the flow of the medium M may be parallel or may meet at another angle. Determining what is suitable in a particular use of the system is suitable based on thermodynamical principles as well as mechanical and technical considerations for how the system can be constructed. The system 1 comprises a loop 50 in which the medium M flows from the contact device 10 to a first control device 20, onwards to a second control device 30, and further onwards to the contact device 10 such that the medium is able to circulate. The first control device 20 may alternatively be referred to as a water content control device 20 and is configured to change a water content of the medium M when the medium M is in the first control device 20 in response to a first control signal $C_1$. That the first control device 20 is configured to change the water content in response to the first control signal $C_1$ may also be defined as applying a water content change, $wc_{charge}$. This may take place by increasing the water content of the medium M by injecting water into a container or conduit in which the medium M is held or transported, or by decreasing the water content by adding a quantity of medium M that has a smaller water content than the medium M already present in the conduit or container such that a combined water content of the added medium M and the already present medium M is decreased. One particularly beneficial example of the first control device 20 is disclosed and discussed below with reference to FIG. 2, and further examples are given and discussed in the Use case examples further below.

It is advantageous for the loop 50 to have the first control device 20 upstream of the second control device 30, so that the medium M need only travel a short distance in the loop 50 after heating to preserve the thermal energy in the medium M and avoid cooling taking place in conduits of the loop 50. However, in some embodiments the second control device 30 could instead be placed upstream of the first control device 20, and this may be of particular advantage in embodiments where the buffer is small so that a total quantity of medium M in the system 1 is not much larger than a quantity circulating in the loop 50 at any given time. After passing the first control device 20, the medium M reaches the second control device 30 that may alternatively be denoted as a thermal energy control device 30 and that serves to adjust a temperature of the medium M by heating or cooling the medium M as it passes through the second control device 30 in response to a second control signal $C_2$. That the second control device 30 is thus configured to change the temperature of the medium M in response to the second control signal $C_2$ may also be defined as applying the temperature change $T_{change}$. This may take place by adding thermal energy through heating of a conduit or container in which the medium M is present or by removing thermal energy through cooling of said conduit or container. One particularly beneficial example of the second control device is given below with reference to FIG. 2 and further examples are given and discussed in the Use case examples section below.

From the second control device 30, the medium M passes to the contact device 10 in which it is brought into contact with the air stream A in order for thermal energy and water vapor to be transferred.

The system 1 further comprises a plurality of sensors S1, S2, S3, S4 for measuring water content and temperature in the medium M and in the air stream A, and the system 1 also comprises processing circuitry 40 that is configured to receive input signals from said sensors S1, S2, S3, S4 and determine a desired water content change, $wc_{charge}$, and a desired temperature change, $T_{change}$, as a first function $f_1$ of the sensor input and also of a second function $f_2$ that defines a relationship between the water content and the temperature of the air stream A as co-dependent variables. The steps performed by the processing circuitry are described in detail in the Method embodiments section below.

The sensors comprise a first sensor S1 that is configured to measure a medium water content parameter, $wc_{medium}$, of the medium and to send signals indicative of the medium water content parameter to the processing circuitry 40. The medium water content parameter, $wc_{medium}$, is a parameter indicative of an amount of water in the medium, and is in the first embodiment suitably measured as a vapor pressure of the medium M. In other embodiments this parameter could alternatively be measured as a conductivity or a density of the medium M. The first sensor S1 is in the first embodiment arranged in the system 1 in such a way that it is able to measure the medium water content parameter, $wc_{medium}$, in the loop 50 downstream of the second control device 30 but upstream of the contact device 10. This has the advantage that the medium water content of the medium M will be known immediately before the medium M enters the contact device 10.

The sensors also comprise a second sensor S2 that is configured to measure a medium temperature of the medium, $T_{medium}$, and to send signals indicative of the air temperature to the processing circuitry. The second sensor S2 is in the first embodiment also arranged in the system 1 upstream of the contact device 10 and downstream of the second control device 30, i.e. in the loop 50 between the second control device 30 and the contact device 10, to be able to measure the temperature of the medium M immediately before the medium M enters the contact device 10. This is advantageous since the temperature of the medium M will be known immediately before the medium M enters the contact device 10.

In some embodiments, the first sensor S1 and/or the second sensor S2 may alternatively be placed in other parts of the loop 50 or even in connection with the first control device 20 or the second control device 30 or any optional component present in the system 1 and through which the medium M flows. In some embodiments, the first sensor S1 and the second sensor S2 may be integrated to form a single component.

The system 1 also comprises a third sensor S3 that is configured to measure an air temperature of the air stream, $T_{air}$, and to send signals indicative of the air temperature to the processing circuitry 40. The third sensor S3 is arranged in a downstream section D through which the air stream A passes after passing through the contact device 1 so that the air temperature is measured after the air stream has been in contact with the medium M. By measuring downstream of the contact device 10, i.e. after the air stream A has been in contact with the medium M, information is obtained of how the contact with the medium M has been able to bring the air temperature, $T_{air}$, towards the setpoint, $T_{set}$. Also, in some embodiments, the processing circuitry 40 is configured to determine an error function that comprises the measured air temperature, $T_{air}$, and the temperature setpoint, $T_{set}$. The processing circuitry 40 may then be configured to determine the first function, f1, so that the error function is minimized, i.e. so that the actual air temperature, $T_{air}$, of the air stream measured by the third sensor approaches or even reaches the temperature setpoint, $T_{set}$. In some embodiments, a combined error function of the temperature and the water content may be determined, as described further below.

Furthermore, the system 1 comprises a fourth sensor S4 that is configured to measure an air water content parameter, $wc_{air}$, of the air stream and to send signals indicative of the air water content parameter to the processing circuitry 40. The air water content parameter is a parameter that is indicative of a water content, i.e. an amount of water present in the air stream, and may be measured as a relative humidity or as any other suitable property of the air stream A that is able to give information directly or indirectly of the water content of the air stream A. The fourth sensor may be a resistive sensor, a capacitive sensor or a dew point sensor. Alternatively, the fourth sensor may measure a refractive index or may be a sensor configured to detect or measure a vapor pressure in the air stream A.

The fourth sensor S4 is also arranged in the downstream section D in order to measure the air water content, $wc_{air}$, of the air stream A after the air stream A has been in contact with the medium M in the contact device 10. By measuring downstream of the contact device 10, i.e. after the air stream A has been in contact with the medium M, information is obtained of how the contact with the medium M has been able to bring the air water content, $wc_{air}$, towards the setpoint, $wc_{set}$. Also, in some embodiments, the processing circuitry 40 is configured to determine an error function that comprises the measured air water content, $wc_{air}$, and the water content setpoint, $wc_{set}$. The processing circuitry 40 may then be configured to determine the first function, f1, so that the error function is minimized, i.e. so that the actual air water content, $wc_{air}$, of the air stream measured by the fourth sensor S4 approaches or even reaches the water content setpoint, $wc_{set}$. In some embodiments, a combined error function of the temperature and the water content may be determined, as described further below.

The downstream section D may be a conduit that guides the air stream A from the contact device 10 or it may alternatively be an area in the space where at least part of the system 1 is placed, as long as the air stream A is able to reach the third sensor S3 and the fourth sensor S4 after it has been in contact with the medium M in the contact device 10.

The system 1 may optionally comprise additional sensors as will be described below with reference to FIG. 2.

Each of the sensors in the system 1 are operatively connected to the processing circuitry 40, and this may suitably be either wire connections or wireless connections or a combination thereof.

Figure 3:
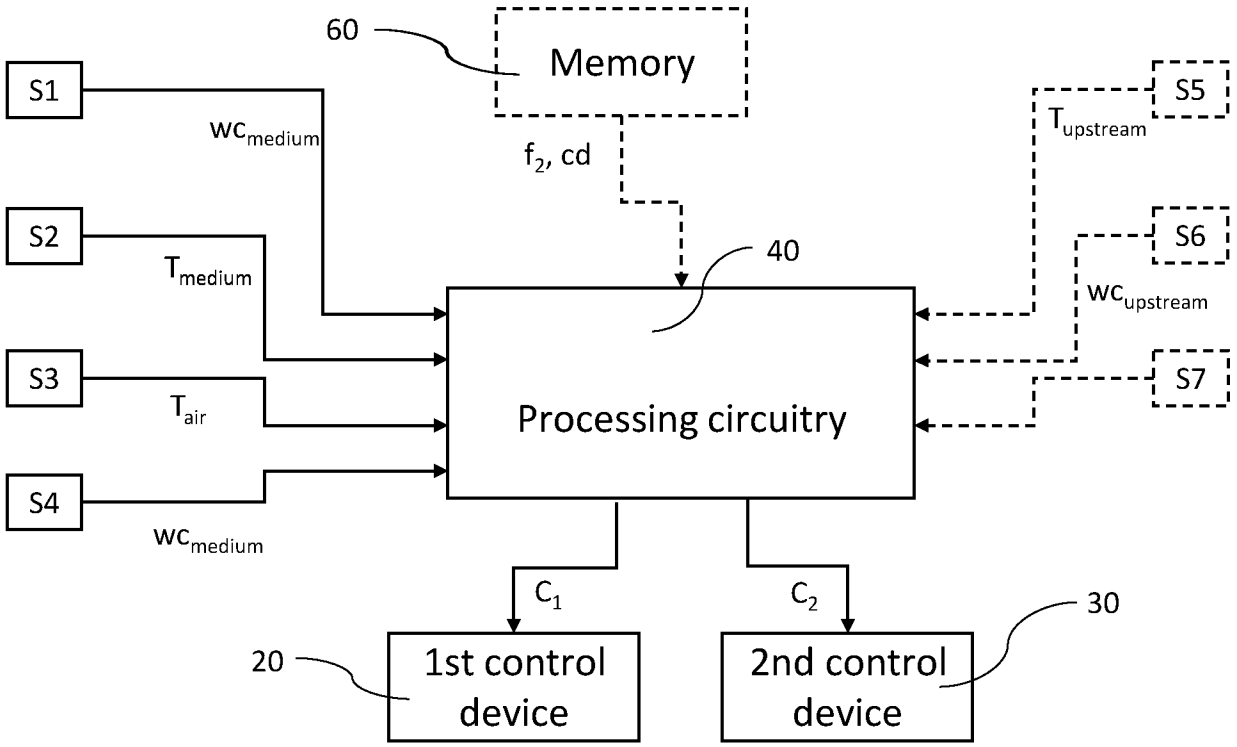

The processing circuitry 40 may be in the form of a control unit comprising a processor and being able to access a memory unit and receive input in the form of the signals from the sensors, as well as emitting output in the form of control signals to the first and second control devices 20, 30. One suitable implementation of the processing circuitry is an industrial PC such as a Beckhoff Industrial PC that comprises a programming and numeric computing platform such as Matlab. Alternatively, other programming and numerical platforms could instead be used, as well as other industrial PCs. In some embodiments, the processing circuitry 40 could be integrated into one component that optionally also includes other parts of the system such as the memory 60. In other embodiments, however, the processing circuitry 40 could instead be distributed in the system 1. The processing circuitry 40 further has access to a second function $f_2$ that defines a relationship between the air temperature, $T_{air}$, and the air water content, $wc_{air}$, as co-dependent variables such that a change in the value of one of the air temperature, $T_{air}$, and the air water content, $wc_{air}$, affects the value of the other. Thus, the second function $f_2$ may be denoted as $f_2(T_{air}, wc_{air})$. In the first embodiment, the second function $f_2$ is a set of equations (1)-(9) and these will be described in more detail further below. However, it is to be noted that any relationship between the air temperature, $T_{air}$, and the air water content, $wc_{air}$, may alternatively be used as long as it is able to define the effect that a change in one of the air temperature and the air water content has on the other. As shown in FIG. 3, the system 1 may comprise or be communicatively connected to a memory 60, the memory 60 being configured to store data, including but not limited to one or more definition of the second function $f_2$. The processing circuitry 40 is in these embodiments configured to receive or retrieve the second function $f_2$ from the memory 60.

The processing circuitry 40 is thus configured to receive signals from each of the sensors S1, S2, S3, S4 and, using the parameters and the second function $f_2$, to determine a desired temperature change, $T_{change}$, and desired water content change, $wc_{change}$ of the medium as a first function $f_1$:

$$(T_{change}, wc_{change}) = f_1(T_{medium}, wc_{medium}, T_{air}, wc_{air}, f_2(T_{air}, wc_{air}))$$

wherein the desired temperature change, $T_{change}$ and the desired water content change, $wc_{change}$ are determined such that after the desired changes are applied, using the first and second control devices 30, 40, the air stream A flowing through the contact device 10 will approach the predetermined temperature setpoint, $T_{set}$, and the predetermined water content setpoint, $wc_{set}$, through contact with the medium M in the contact device 10.

This means that the processing circuitry 40 in this way determines how the temperature and the water content of the medium M should change so that the air flow A leaving the contact device 10 reaches or approaches predetermined setpoints based on the measured temperatures and water content parameters and further based on the known relationship $f_2$ of the air temperature and air water content. By selecting setpoints for the air temperature and the air water content, and by using input from each of the sensors S1, S2, S3, S4 and the second function $f_2$, the processing circuitry 40 is able to determine how these setpoints are to be reached in an energy efficient and convenient way, in a single step.

When the desired temperature change, $T_{change}$ and the desired water content change, $wc_{change}$ have been determined, the processing circuitry 40 is also configured to generate a first control signal, $C_1$, that is configured to cause the first control device 20 to apply the water content change, $wc_{change}$, to the medium M such that the medium water content changes from the value of the medium water content parameter, $wc_{medium}$, by applying the desired water content change, $f(wc_{medium},wc_{change})$ The processing circuitry 40 is also configured to generate a second control signal, $C_2$, which is configured to cause the second control device to apply the temperature change, $T_{change}$ to the medium such that the medium temperature changes from the measured medium temperature, $T_{medium}$, by applying the desired temperature change, $f(T_{medium},T_{change})$. Applying the desired water content change, $f(wc_{medium},wc_{change})$, may comprise adding water to or removing water from the buffer in the first control device 20, and it may comprise doing this in one single change or in a plurality of stepwise changes that are applied over a period of time. Similarly, applying the desired temperature change, $f(T_{medium},T_{change})$ may comprise increasing or reducing heat that is applied to the medium by the second control device 30, and the increase or reduction may be achieved as a single change or as a plurality of stepwise changes over time. Also, the desired water content change, $f(wc_{medium},wc_{change})$, and the desired temperature change, $f(T_{medium},T_{change})$, may be in the form of an equation containing both the present water content and the water content change or the present temperature and the temperature change, respectively. Such equation may be in the form of a polynomial, an integral, or any other suitable form.

The processing circuitry 40 is suitably also operatively connected to the first and second control device 20, 30, and is configured to control the first control device 20 and the second control device 30 by transmitting the first and second control signals, $C_1$, $C_2$, to them.

In the first embodiment, the first control signal, C1, may cause the first control device 20 to apply the water content change by opening or shutting valves and/or by operating at least one pump and/or at least one injector for any other suitable component or increasing or decreasing the water content of the medium M.

Also, the second control signal, C2, may in the first embodiment cause the second control device 20 to apply the temperature change by increasing or decreasing a temperature of a heating element that is in thermal contact with the medium M or by operating at least one valve and/or at least one pump or any other suitable component for increasing or decreasing the temperature of the medium M.

The system 1 may also comprise at least one circulation means such as a pump 51 or the like (see FIG. 2) that serves to circulate the medium M in the loop 50.

The function and operation of the system 1 will now be described in more detail with reference to the flow of the medium M in the loop 50.

After being in contact with the air stream A, medium M that leaves the contact device 10 through a contact device outlet 12 is transported to the first control device 20 in which the water content of the medium M is adjusted in response to the first control signal $C_1$. One way of adjusting is disclosed in more detail below with reference to FIG. 2 and other ways are also described further below in the Use case examples. In some embodiments, adjusting the water content of the medium may result in medium M leaving the first control device 20 in order to proceed in the loop 50 having the water content that causes the air stream A to reach the water content setpoint, $wc_{set}$, but in other embodiments the medium M may instead have a water content that causes the air stream A to approach the water content setpoint, $wc_{set}$, so that an error between the air water content, $wc_{air}$, and the water content setpoint is decreased. The first control device 20 comprises a first control device inlet 21 that is connected to the loop 50 downstream of the contact device 10 and also comprises a first control device outlet 22 that is connected to the loop 50 downstream of the first contact device 20 so that medium M may proceed to the second control device 30 and enter through a second control device inlet 31.

After leaving the first control device 20, medium M is thus transported to the second control device 30 in which its temperature is adjusted in response to the second control signal $C_2$. In some embodiments, the medium M leaving the second control device 30 has a temperature that causes the air stream A to reach the temperature setpoint, $T_{set}$, by thermal contact with the air stream A in the contact device 10. In other embodiments, the medium M has a temperature when leaving the second control device 30 that causes the air temperature to approach the temperature setpoint, $T_{set}$, so that an error between the air temperature and the temperature setpoint, $T_{set}$, is decreased.

The change in water content applied in the first control device 20 in response to the first control signal, $C_1$, and the change in temperature applied in the second control device 30 in response to the second control signal, $C_2$, cause the medium M to obtain a water content and temperature such that the air stream A through contact with the medium M in the contact device 10 approaches or reaches the water content setpoint, $wc_{set}$ and the temperature setpoint, $T_{set}$. Thus, the water content and temperature of the medium are changed in one single step since both the water content and the temperature are changed in response to determining the first function, f1, using the second function $f_2$ that define a relationship between the air water content, $wc_{air}$, and the air temperature, $T_{air}$, as co-dependent variables. From a second control device outlet 32 of the second control device 30, the medium M is then transported in the loop 50 to a contact device inlet 11 and is inserted into the contact device 10 where a contact between the medium M and the air stream A causes thermal energy and water vapor to be transported from the medium M to the air stream A or vice versa. In some situations, the air stream A receives water vapor and/or thermal energy from the medium M and in some situations the medium M instead receives water vapor and/or thermal energy from the air stream A. It is a great benefit of the invention to be able to selectively transfer thermal energy and water vapor from one to the other of the air stream A and the medium M depending on the temperature setpoint, $T_{set}$, and the water content setpoint, $wc_{set}$.

The first sensor S1 and the second sensor S2 are in the first embodiment configured to measure the water content and the temperature of the medium M in the loop 50 between the second control device 30 and the contact device 10, i.e. after both water content and temperature of the medium M have been adjusted. In some embodiments, the first sensor S1 and/or the second sensor S2 could instead be configured to measure the medium M in other parts of the loop 50, such as immediately downstream of the contact device 10 or between the first control device 20 and the second control device 30.

During operation, the system 1 is suitably configured to repeatedly measure water content and temperature of the medium M and of the air stream A downstream of the contact device 10, and the processing circuitry 40 is configured to repeatedly receive signals from each of the sensors S1, S2, S3 and S4 and to update the first function $f_1$ using the measured parameters and/or measured values as input. Also, the processing circuitry 40 is configured to update the first control signal $C_1$ and the second control signal $C_2$ in response to the updated first function $f_1$. The temperature and water content of the medium M are thereby repeatedly adjusted in the first control device 20 and the second control device 30.

It is to be noted that the sensors described herein as measuring a parameter and/or a value of a parameter of the medium M may be configured to perform the measurement in the loop 50 or in any other conduit where the medium M is transported. However, such sensors may alternatively be configured to measure the parameter and/or the value in a side conduit or similar where a quantity of the medium M is transported and that does not form part of the loop 50, as long as the measured parameter and/or value is able to give information of a property such as a temperature, a water content, or another property of the medium M that circulates in the system 1. Similarly, sensors described herein as measuring a parameter and/or a value of the air stream A may be configured to perform the measurement in a conduit guiding the air stream A to or from the contact device, but it may alternatively perform such measurements in a separate conduit or in an area through which the air flow A passes before or after being led through the contact device 10. It may also in some embodiments be suitable to perform such measurements in connection with or inside the contact device 10.

Figure 2:
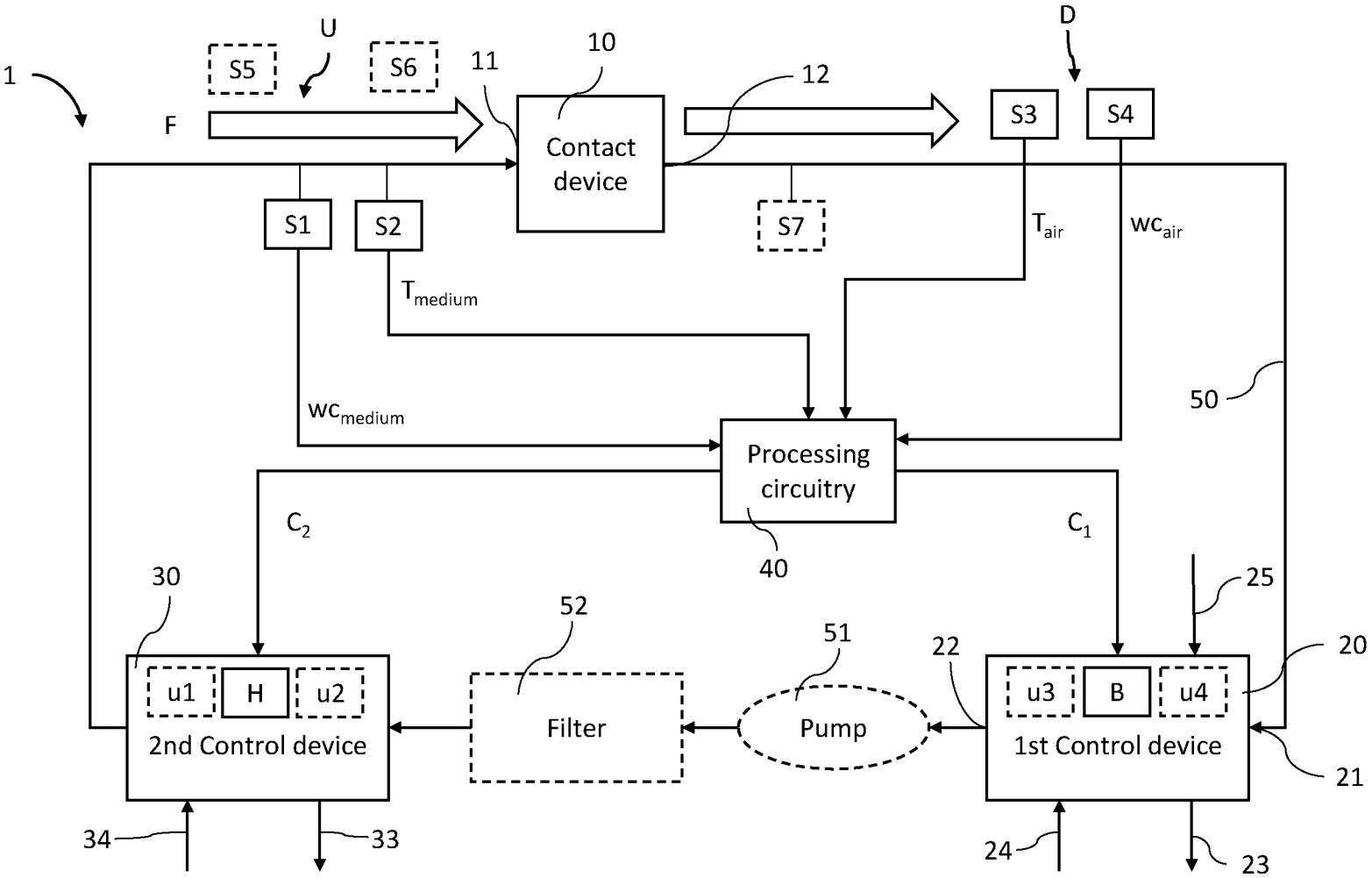

FIG. 2 discloses a second embodiment of the system 1 and comprises additional sensors in the form of a fifth sensor S5 and a sixth sensor S6. The fifth sensor S5 is configured to measure an upstream air temperature of the air stream, $T_{upstream}$, and to send signals indicative of the temperature to the processing circuitry 40, either through a wire connection or a wireless connection. The sixth sensor S6 is configured to measure an upstream air water content parameter, $wc_{upstream}$, of the air stream A and to send signals indicative of the upstream air water content to the processing circuitry 40. The upstream air water content parameter is a parameter that is indicative of an amount of water in the air stream A. The fifth sensor S5 and sixth sensor S6 are configured to measure the upstream air temperature and upstream air water content in an upstream section U that is a section that the air stream A passes before flowing through the contact device. In this way, the fifth sensor S5 and the sixth sensor S6 are able to measure these properties of the air stream A before the air stream A reaches the contact device 10.

The processing circuitry 40 is configured to receive a fifth input signal comprising the measured upstream air temperature, $T_{upstream}$, from the fifth sensor S5, and also to receive a sixth input signal comprising the measured upstream air water content, $wc_{upstream}$, from the sixth sensor S6. Also, the processing circuitry 40 is in the second embodiment configured to determine the first function $f_1$ based also on the received parameters from the fifth and sixth sensors S5, S6, such that the first function $f_1$ is determined as:

$$(T_{change}, wc_{change}) = f_1(T_{medium}, wc_{medium}, T_{air}, wc_{air}, f_2(T_{air}, wc_{air}), T_{upstream}, wc_{upstream})$$

This has the advantage of being able to take into account not only what the values of the temperature and the water content are as the air stream A exits the contact device 10, but also the values of the temperature and the water content before the air stream A enters the contact device 10. The processing circuitry is thus configured to be able to take into account how much the temperature setpoint and the water content setpoint differ from the upstream air temperature and the upstream air water content.

Furthermore, the processing circuitry 40 is suitably configured to use also at least one contact device parameter, cd, when determining the first function $f_1$. The first function $f_1$ is then defined as:

$$(T_{change}, wc_{change}) = f_1(T_{medium}, wc_{medium}, T_{air}, wc_{air}, f_2(T_{air}, wc_{air}), cd)$$

The at least one contact device parameter, cd, may be predetermined and may be comprised in the memory 60 or in another manner be available to the processing circuitry 40. However, at least one contact device parameter, cd, may alternatively be determined using input signals from at least one of the sensors of the system 1. At least one contact device parameter, cd, may also optionally have a predetermined value but be adjusted at suitable intervals using sensor input and/or other suitable input that is measured or detected in the system 1 or that is given as input from an external unit or from a human operator.

One contact device parameter, cd, may be a mass flow of the air stream A. This can be determined by measuring the flow of air upstream or downstream of the contact device 10 or inside the contact device 10 itself. If the mass flow is high, this indicates that a contact time between the air stream A and the medium M is small whereas a smaller mass flow instead indicates a longer contact time. By using the mass flow of the air stream A as a contact device parameter, cd, the processing circuitry 40 is able to determine the desired temperature change, $T_{change}$ and the desired water content change, $wc_{change}$ of the medium M so that a shorter or longer contact time can be compensated for. It is beneficial to be able to adjust temperature and/or water content of the medium M depending on whether a large amount of water vapor or thermal energy needs to be transferred per unit of time, compared with if only a small amount of water vapor or thermal energy is to be transferred per unit of time.

Another contact device parameter, cd, is suitably a mass flow of the medium M. This can be determined by using at least one additional sensor S7 for measuring a flow of the medium M in connection with the contact device 10 or in the loop 50 upstream or downstream of the contact device 10. In FIG. 2, the additional sensor S7 is shown downstream of the contact device 10, but it is to be noted that other placements of the additional sensor S7 are equally possible as long as the additional sensor S7 is able to measure the flow of the medium M. Knowing the mass flow of the medium M is beneficial since a large mass flow indicates that a large quantity of the medium M enters the contact device 10 per unit of time, whereas a lower mass flow instead indicates that a smaller quantity of the medium M enters the contact device 10 per unit of time. This in turn enables the processing circuitry to determine or update the first function f1 using this information so that the temperature and the water content of the medium M may be determined to be able to transfer thermal energy and water vapor to the air stream A such that the temperature setpoint and the water content setpoint are approached or reached.

Another contact device parameter, cd, is suitably a back pressure. This may be a known parameter of the particular contact device 10 used in any given embodiment of the system 1, but it may alternatively be measured or estimated before or during use of the system 1 and it may also optionally be updated during use due to variations that may arise during prolonged use of the system 1. The back pressure and other contact device parameters, cd, may be used as a parameter in the second function, $f_2$, in order to define the relationship between the air temperature and the air water content.

The first control device 20 in the second embodiment of FIG. 2 comprises a buffer B that holds a quantity of the medium M. This quantity may be large, such as at least ten times a volume of the medium M that circulates in the loop 50 during use of the system, or even at least a hundred times said volume. However, the quantity in the buffer B may also be smaller such as less than five times the volume of the medium M circulating in the loop 50 at any given time. A larger quantity of medium M in the buffer B is advantageous in ensuring that a supply of medium M into the loop 50 is always possible and that addition and removal of water from the medium M may take place as desired, either continuously or at suitable intervals. However, a smaller buffer B is advantageous since any change of the water content of the medium M in the buffer B will take effect on the medium M in the loop 50 very soon since the addition or removal of water in the buffer B will affect the medium M currently being introduced into the loop 50 downstream of the first control device 20.

The first control device 20 of the second embodiment is configured to add water to increase the medium water content by injecting water directly into the buffer. This is achieved by the first control signal C1 being configured to cause an opening of a water addition valve u3 through which a supply of water into the buffer B then takes place. The first control device 20 is configured to control the amount of water being added through control of water flowing into the buffer through the water addition valve u3 and by opening and closing the water addition valve u3 as desired this amount may be adjusted with precision. For removing water, the first control device 20 is instead configured to operate a regeneration valve u4 in response to the first control signal $C_1$ so that a quantity of medium M in the buffer B is transported from the buffer B to be regenerated. Regeneration may take place in connection with or inside the first control device 20, but may in some embodiments alternatively take place in a separate regeneration unit that is place in another part of the system 1 or even outside the system 1. A regeneration supply conduit 23 is in such embodiments arranged to supply medium M from the buffer B to such regeneration unit in which water is removed from the medium M through regeneration. This process is well known within the art and will not be described in more detail herein. The water content of the medium M in the buffer B may be increased by injecting water from a water conduit 25.

From the regeneration unit a regeneration discharge conduit 24 supplies regenerated medium M to the buffer B where it is mixed with medium M already present in the buffer B. In some embodiments, regenerated medium M may instead be supplied directly to the first control device outlet 22. The quantity of medium M that is regenerated may be controlled by selectively operating the regeneration valve u4 in response to the first control signal $C_1$.

When a large buffer B is provided, regeneration of the medium M in order to apply the change of water content may be performed for a longer time period than in embodiments where a smaller buffer B is used. This is due to the fact that changes to the water content of the medium M in the buffer B as a whole depend on the amount of regenerated medium as compared to the medium M in the buffer B.

Downstream of the first control device 20 in the loop 50, a pump 51 may be provided to pump the medium M towards the second control device 30. This has the advantage that the flow of medium M in the loop 50 may be controlled, suitably by the processing circuitry causing the pump to operate in response to a third control signal. Alternatively, the pump may be set to operate to pump a predetermined volume per unit of time and to continue this operation as long as the system 1 is active. In some embodiments, the pump 51 may be placed in other parts of the loop 50 and a plurality of pumps may alternatively also be used. In the second embodiment, a filter 52 is also provided for filtering the medium M to remove any impurities. In some embodiments, the filter 52 may be placed in other parts of the loop 50 or alternatively in connection with one of the first control device 20 and second control device 30.

The second control device 30 in the second embodiment comprises at least one heat exchanger H that may be arranged inside the second control device 30 or that may be arranged as a separate unit to which a heat exchanger supply conduit 33 is then arranged to supply the medium M. After being heated or cooled in the separate heat exchanger, a heat exchanger discharge conduit 34 is provided to return the medium M to the second control device 30. In order to transport the medium M to the heat exchanger H, a heat addition valve u1 may be provided together with a heat removal valve u2. Suitably, two separate heat exchangers may be provided that each serve to either heat the medium M or cool the medium M, and to which the supply of medium M is controlled by the heat addition valve u1 and the heat removal valve u2, respectively. The second control device 30 is then suitably configured to operate the heat addition valve u1 and the heat removal valve u2 in response to the second control signal $C_2$ to selectively provide medium M to be heated or cooled in order to apply the temperature change $T_{change}$. Downstream of the second control device 30, the medium M is supplied to the contact device 10 as previously described.

In some embodiments, the first control device 20 and the second control device 30 may be combined into one single component, and in other embodiments they may instead be divided into a plurality of separate units that interact as desired to change the water content and the temperature of the medium M after the medium M has been discharged from the contact device outlet 12 in order to prepare the medium M for once again entering the contact device inlet 11 of the contact device 10.

FIG. 3 discloses the processing circuitry 40 and the other parts of the system 1 that are configured to communicate with the processing circuitry 40 by sending signals to the processing circuitry 40 or by receiving signals from the processing circuitry 40. Thus, the processing circuitry 40 is configured to receive sensor input from the first sensor 51, the second sensor S2, the third sensor S3, the fourth sensor S4, and suitably also optional fifth sensor S5, sixth sensor S6, and/or additional sensor S7.

Based on the received parameters, and also based on the second function $f_2$ and suitably the optional at least one contact device parameters, cd, the processing circuitry 40 determines the desired change values using the first function $f_1$. The memory 60 may in this embodiment be configured to store, and the processing circuitry 40 be configured to receive or retrieve from the memory 60, one or more measured parameter and/or value from any or all of the sensors comprised in the system and/or at least one contact device parameter cd. The memory 60 may suitably store measured parameters and/or values over time. The processing circuitry 40 then generates the first control signal $C_1$ and the second control signal $C_2$, and suitably transmits them to the first control device 20 and the second control device 30, respectively, where the water content and the temperature of the medium M is adjusted in response to said control signals $C_1$, $C_2$.

The second function $f_2$ used by the processing circuitry 40 will be disclosed in more detail further below. Due to the use of the second function $f_2$ as well as the sensor input, the system 1 is able to control the water content and temperature of the air stream A in a highly time and cost-efficient way and to avoid a common problem with prior art systems, namely that changing one of the temperature and the water content of the air stream causes a change in the other that will then need to be compensated for. By applying the second function $f_2$ when determining the desired temperature change $T_{change}$ and the desired water content change $wc_{change}$, and thereby taking into consideration the codependence of air temperature and air water content, the need for such compensations is minimized or even eliminated.

The processing circuitry 40 may suitably determine the first function $f_1$ using at least one proportional-integral-derivative controller, PID. If more than one is used, they suitably share the second function $f_2$ and communicate with each other at suitable intervals in order to control the water content and the temperature of the medium M in an efficient way.

In some embodiments, the processing circuitry instead determines the first function $f_1$ using a linear-quadratic regulator, LQR. Alternatively, the processing circuitry 40 instead determines the first function $f_1$ using model predictive control, MPC. Advantages of LQR and MPC are given in the Summary section above.

The system 1 is able to operate with setpoints for the air temperature, $T_{air}$, and air water content, $wc_{air}$, that are within operative ranges for the system 1. For instance, if the second control device 30 is able to cool the medium M to a minimum temperature of 7° C. and to heat the medium M to a maximum temperature of 45° C., the temperature setpoint is suitably set as within the range of 7-45° C. In some embodiments it could alternatively be possible to operate with a setpoint outside of this range, but it is to be understood that the most cost-efficient operation of the system 1 is within this range. If it is desired to change the operative range this can be done by configuring the second control device 30 to be able to heat and/or cool the medium to even higher or lower temperatures, thus updating the operative range or forming a new range. Similarly, the water content of the medium M is limited by properties of the first control device 20 and of the medium M itself. An operative range of the system 1 is determined by how much water can be held by the medium M. As an example, Magnesium Chloride, MgCl2, may in a lower end of the range carry about 33% water and an upper end of the range may be determined by how much water may be injected into the buffer. In some embodiments, the additional sensor S7 may be a plurality of sensors that are configured to measure different parameters in the system 1. In one embodiment, such a parameter may be an air velocity upstream of the contact device 10, downstream of the contact device 10 or inside or in connection with the contact device 10.

METHOD EMBODIMENTS

Figure 4:
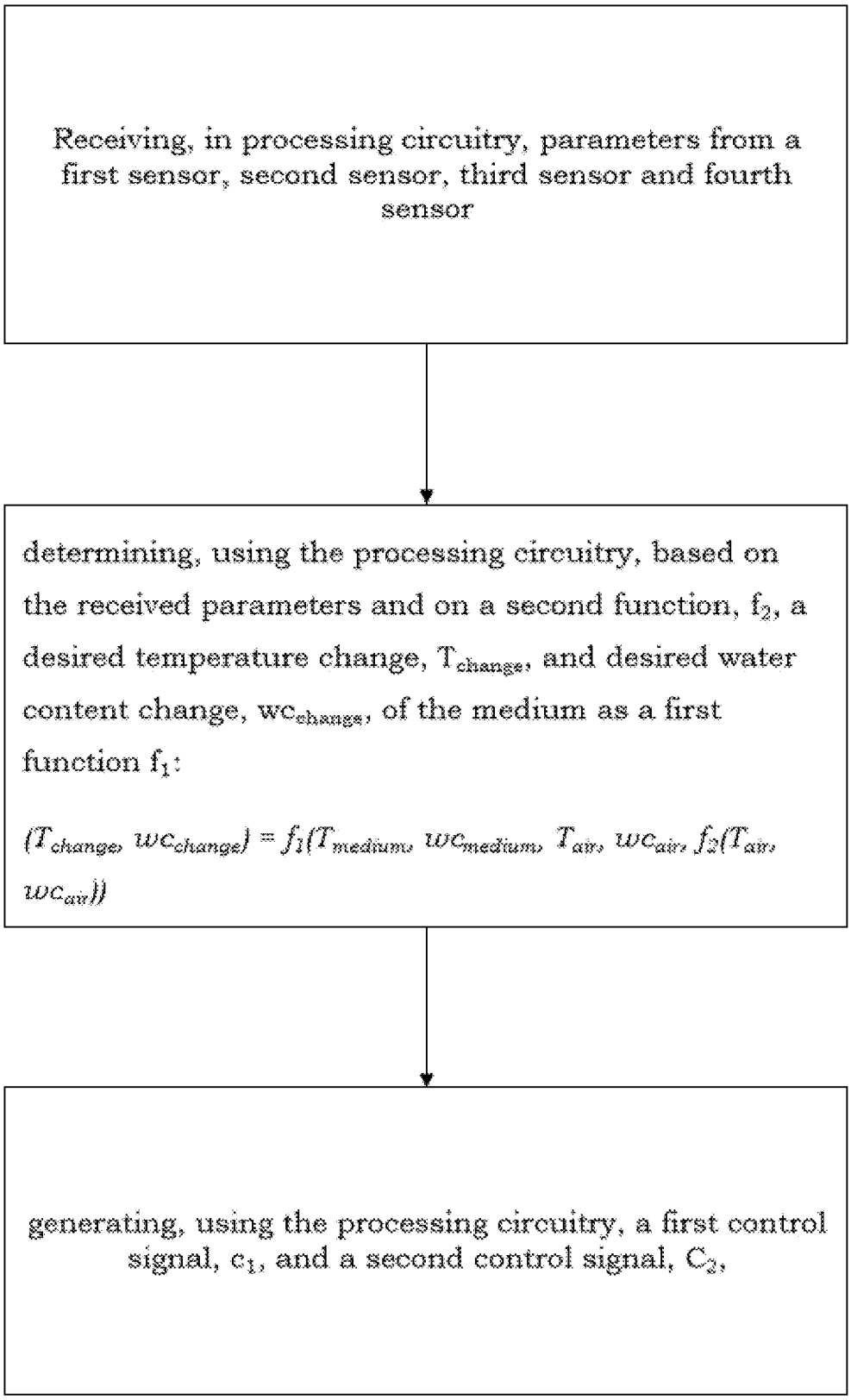
FIG. 4 is a flow diagram of a method according to an embodiment of the invention.

The inventive computer implemented method will now be described with reference to FIG. 4 and FIG. 5. The computer implemented method as shown in FIG. 4 comprises:

In step 110: Receiving, in processing circuitry 40, parameters from a first sensor 51, second sensor S2, third sensor S3 and fourth sensor S4. These parameters are the measured $wc_{medium}$, $T_{medium}$, $T_{air}$ and $wc_{medium}$ as described above.

In step 120: determining, using the processing circuitry 40, based on the received parameters and on a second function, $f_2$, a desired temperature change, $T_{change}$, and desired water content change, $wc_{charge}$, of the medium M as a first function f1:

$$(T_{change}, wc_{change}) = f_1(T_{medium}, wc_{medium}, T_{air}, wc_{air} f_2 (T_{air}, wc_{air}))$$

The second function $f_2(T_{air}, wc_{air})$ defines a relationship between the air temperature, $T_{air}$, and the air water content, $wc_{air}$, as co-dependent variables, such that a change in the value of one of the air temperature, $T_{air}$, and the air water content, $wc_{air}$, affects the value of the other.

In one particularly advantageous embodiment, the second function $f_2$ is given by a set of equations (1)-(9) and explained as follows. The equations (1)-(9) presented below are also shown in FIG. 6.

Let A be a contact area between the air stream and the medium in an interaction surface of the contact device 10, and $T_s$ the temperature of the medium, $T_{medium}$, in the interaction surface. Let $T_a$ be the temperature of the air stream, $T_{air}$, in the interaction surface, and let α be a transmission constant for the heat and β be a transmission constant for the water vapor mass flow. Also, let $P_{vs}$ be a vapor pressure of the medium, $P_{va}$ be a vapor pressure of the air, q be a mass transfer of water between the medium and the air stream, and P be a heat transfer between the medium and the air.

The heat transfer P and mass transfer q between the solution and the air depends on the temperature and vapor pressure difference and some constant transmission constants α and β. α and β in turn are functions of an air velocity, air turbulence, and on physical properties of the interaction surface. For contact devices 10 used with the present invention, α and β may be known and be used as contact device parameters or may alternatively be determined or measured before or during use and may alternatively also be updated during use if suitable to compensate for changes to properties of the contact device and of the air stream.

It is desired to have a setup with a high α and β. It is also desired to have a high contact area A between the medium and the air. A high surface area A will facilitate both a high heat transfer and a high mass transfer. It should also be noted that α and β are functions of air velocity. For example, a may be determined as $\alpha=12.12-1.16\ v+11.6\ v^{1/2}$.

α and β may also determine an operative range of the system, i.e. a range of water contents that are possible to carry in the medium M.

The heat and mass transfer can be expressed, or at least approximated, by $$P=\alpha(v)A(T_s-T_a) \tag{1}$$

$$q=\beta(v)A(P_{vs}-P_{va}) \tag{2}$$

Let $RH_a$ be a relative humidity of the air stream and let $w_a$ be a water activity of the solution. Here, it should be noted that the water activity, $w_a$, of the medium depends on the water content in the medium.

Using the Antoine equation, the vapor pressure of the air can be expressed as $$P_{va} = \frac{RH_a}{100} 10.0^{\left(A_m - \frac{B_m}{C_m + T_a}\right)} \tag{3}$$

where $A_m$, $B_m$ and $C_m$ are Antoine constants. Using the same approach, the water pressure of the solution can be expressed as $$P_{vs} = w_a(w_c) 10.0^{\left(A_m - \frac{B_m}{C_m + T_a}\right)} \tag{4}$$

where $w_c$ is the water content, in the medium, $wc_{medium}$. Here it should be noted that both equations (3) and (4) depend on the temperature of the air, $T_{air}$, and the temperature of the medium, $T_{medium}$.

The four equations (1)-(4) given above thus define a relationship between the heat transfer P and the mass transfer q.

Instead of the Antoine equation, the Wagner equation or any other equation that describes vapor pressure in air may be used.

a is a function of the velocity of air. A typical values for a may be 26 where the ambient air moves at an air velocity of 2 m/s. β is also a function of the air velocity. The water activity $w_a$ is a function of the water content in the medium M and depends on the medium M that is used.

Therefore, a change of temperature in the air or in the medium will have an impact on the mass transfer between the air and the medium. Furthermore, when water is transferred between the air and the medium, a phase transition takes place. The enthalpy of vaporization/condensation in the phase transition will have an impact on the temperature of the air, $T_{air}$, and the temperature the medium, $T_{medium}$. Let $E_v$ be the enthalpy of vaporization/condensation and let $w_c$ be the water content in the medium, $wc_{medium}$. The heat from the phase transition $P_{Ev}$ is given by $$P_{Ev}=E_v(T_a)q \tag{5}$$

How the temperature of the air, $T_a$, and the temperature of the medium, $T_s$, change as a function of time can be expressed as $$\frac{T_s}{dt} = \frac{-P_{Ev} - P}{C_{ps}m_s} \tag{6}$$

$$\frac{T_a}{dt} = \frac{P_{Ev} - P}{C_{pa}m_a} \tag{7}$$

How the water content of the air $x_a$ and the water content of the medium $w_a$ change as functions of time can be expressed as $$\frac{x_a}{dt} = \frac{q}{m_a} \tag{8}$$

$$\frac{m_w}{dt} = -q \tag{9}$$

where $C_{ps}$ and $C_{pa}$ are a specific heat capacity of the medium and the air, respectively, and $m_s$ and $m_a$ are the mass of the solution and the air. Therefore a multi-variable control approach is suitable. $E_v$ is a function of the medium temperature $T_s$.

Ambient parameters such as an ambient temperature, ambient pressure, or other parameters may also in some embodiments be used to determine at least some of the parameters mentioned above in connection with the equations of the second function $f_2$.

By using these equations as the second function $f_2$, the processing circuitry 40 is able to determine the first function $f_1$ in an advantageous way that overcomes drawbacks of the prior art so that efficient control of water content and temperature of the air flow A is achieved.

In some embodiments, the equations given above may be modified or altered within the scope of the present invention, as long as the second function $f_2$ is able to define a relationship between the air temperature, $T_{air}$, and the air water content, $wc_{air}$, as co-dependent variables such that a change in the value of one of the air temperature, $T_{air}$, and the air water content, $wc_{air}$, affects the value of the other.

This means that the second function, $f_2$, may comprise at least one equation that defines this relationship. In some embodiments, the second function, $f_2$, is not dependent on any contact device parameters, cd, such as the above mentioned α and β. In other embodiments, the second function, $f_2$, comprises the parameters given above in the equations (1)-(9) and also comprises other parameters and relationships between them and between them and at least one of the parameters given above in equations (1)-(9).

It is to be noted that the set of equations given above is to be seen as one advantageous way of defining the relationship between the air temperature and the air water content. Using this set of equations enables a reliable and efficient control of the temperature and water content of the air stream, but it is especially to be noted that other sets of equations or a modified form of the equations (1)-(9) may alternatively be used within the scope of the present invention.

The method may also comprise, in an optional step 125: receiving or retrieving, in the processing circuitry, the second function $f_2$.

The second function $f_2$ may be received or retrieved from the memory 60, as described herein. In some embodiments, optional step 125 is performed repeatedly so that the second function $f_2$ is received or retrieved more than once.

The method also comprises:

In step 130: generating, using the processing circuitry, a first control signal, $C_1$, and a second control signal, $C_2$. The first control signal C1 is configured to cause the first control device 120 to apply the water content change, $wc_{change}$, to the medium M such that the medium water content changes from the value of the medium water content parameter, $wc_{medium}$, by the desired water content change, f(wc, $wc_{change}$). Also, the second control signal $C_2$ is configured to cause the second control device to apply the temperature change, $T_{change}$ to the medium such that the medium temperature changes from the measured medium temperature, $T_{medium}$, by the desired temperature change, f($T_{medium}$, $T_{change}$) In some embodiments, the change by the desired water content change f(wc, $wc_{change}$) may be in the form of an addition or subtraction by the water constant change, $wc_{change}$, but in other embodiments a different relationship may exist between the value of the medium water content parameter and the desired water content change such that the desired water content change may be arrived at by integration or other mathematical operations. Similarly, the relationship between the value of the medium temperature parameter and the desired temperature change may be in the form of an addition or subtraction or may alternatively be another mathematical relationship.

Figure 5:
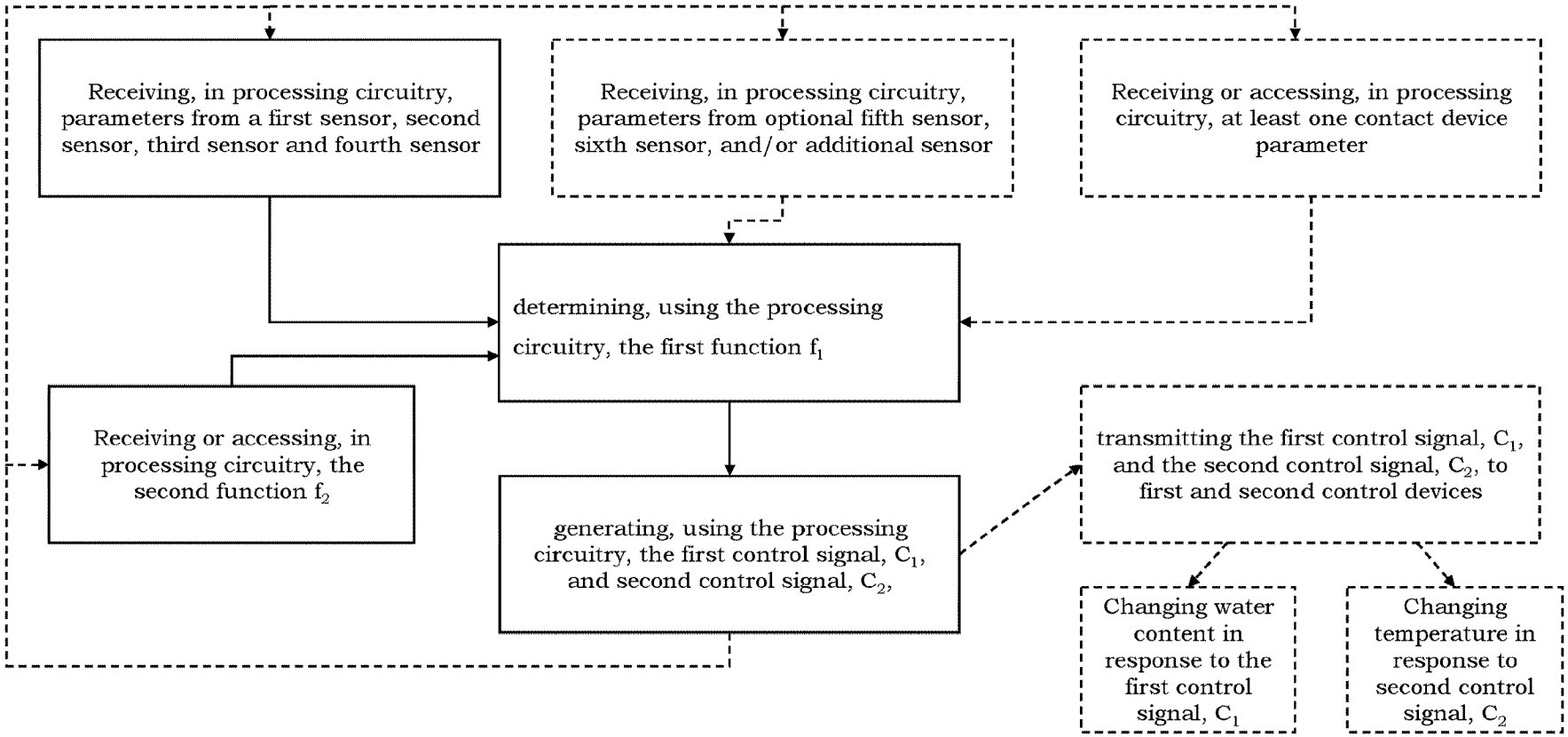
FIG. 5 is a flow diagram of a method according to one or more embodiment of the invention.

FIG. 5 discloses the method of the invention with optional steps included. Thus, the embodiment of FIG. 5 also comprises:

In one or more embodiments, repeatedly performing steps 110, 120 and 130 as described above.

In optional step 150: Receiving, in processing circuitry, parameters from optional fifth sensor, sixth sensor, and/or additional sensor. Using the upstream parameters measured by the fifth sensor S5 and/or the sixth sensor S6 allows for determining both how large a change of the air water content and the air temperature are caused by the interaction in the contact device 10. Also, parameters measured by the additional sensor S7 allows for determining differences in parameters of the medium M in different parts of the loop 5 of the system 1. In some embodiments, optional step 150 is performed repeatedly.

In optional step 160: Receiving or accessing, in processing circuitry, at least one contact device parameter, cd. Such contact device parameters may be comprised in a memory, such as the memory 60, or in other ways be available to the processing circuitry. Using contact device parameters allows for determining the first function $f_1$ to also take into consideration factors that affect the interaction of the medium M and the air stream A inside the contact device 10. In some embodiments, optional step 160 is also performed repeatedly.

Furthermore, the method may comprise

In optional step 170: transmitting the first control signal to the first control device 120 and transmitting the second control signal to the second control device 130.

In optional step 180: changing the medium water content in response to said first control signal, and In optional step 190: changing the medium temperature in response to said second control signal.

In some embodiments, the processing circuitry 40 is configured to perform the steps of the method continuously, whereas in other embodiments the processing circuitry 40 may instead be configured to perform the method at predetermined intervals or in response to sensor input differing more than a predetermined threshold from the desired values. Suitably, the processing circuitry may be configured to determine an error function for the air temperature, $T_{air}$, and for the air water content, $wc_{air}$, and the processing circuitry may determine the desired temperature change and the desired water content change in order to minimize this error function. Thus, a total error may be given by $error_{tot}=c1 \cdot error_{wc}+c2 \cdot error_T$, where c1 and c2 are constants that may optionally be updated during use of the system 1. In some embodiments, regeneration is performed continuously in order to remove water from the medium M, and the first control signal C1 may in such embodiments control a position of the valves such that they are open to a certain degree and thereby allow a given volume per time unit of medium M to be transported to regeneration.

In some embodiments, the method comprises receiving, and the processing circuitry 40 is configured to receive, sensor input at given time intervals and to generate the first and second control signals at intervals so that the temperature and water content of the medium are changed. In other embodiments the method comprises receiving, and the processing circuitry 40 is configured to receive, the sensor inputs continuously and a difference between the received measurements and the setpoints is determined. The first and second control signals are then generated when the difference is larger than a given threshold or when the measured values differ more than a predetermined amount from the setpoints.

In some embodiments, a plurality of buffers containing medium M of different water contents may be used in the first control device 20 and the first control signal may be configured to cause the first control device 20 to determine which buffer or which combination of buffers that is to be used for discharging the medium M from the first control device 20. In this way, the water content of the medium M may be changed more rapidly. Regeneration may take place continuously or at intervals in order to maintain the water content of each buffer at a desired level.

Use Case Examples

Example 1

In this Example, the inventive system and method are used to control temperature and water content in an air flow in an indoor space.

The contact device is in the form of the cellulose based pad CeLPad 0760 manufactured by HUTEK. The CeLPad 0760 has a 45/15 flute angle configuration and increases contact time between the medium and the airflow. In the system, a combined filter and pump (PACER) is used and the second control device is in the form of a heat exchanger (manufactured by ALFA LAVAL). The first control device comprised a buffer with a volume of 150 liter, and the water content is increased by injecting water into the buffer and decreased by regenerating the medium. The medium itself is a potassium formate or alternatively a potassium acetate. Both media were used and were shown to yield similar results.

The processing circuitry comprised an MPC regulator to determine the first function and arrive at the desired water content change and the desired temperature change.

Simulation results using the MPC regulator and real weather conditions for Uppsala, Sweden are shown in FIG. 7. Very similar results were achieved in a second simulation performed using PID regulators.

The system was operated for 24 hours during which humidity and temperature of ambient air varied as shown below. The temperature setpoint was set at 20° C. and the water content setpoint as a relative humidity of 50%.

The system is able to compensate for variations in the water content and temperature so that the properties of the air flow after passing through the contact device are at the temperature setpoint and water content setpoint or varying only slightly from those setpoints. It is to be noted in particular that the change taking place at about 9 hours when the system is no longer required to remove water vapor from the air flow but instead add water vapor to the air flow is handled efficiently by the system so that the air flow downstream of the evaporative pad approaches or is held at the setpoints both before and after this change.

There is some variation in the water content of the air flow downstream of the evaporative pad as the water content of the upstream air flow changes more rapidly from 18 hours onwards but the system is still able to provide a smooth curve without sudden changes.

It was also noted that the system was able to yield a stable output so that water content and temperature of the air was held stable despite variations in both ambient water content and ambient temperature of the air throughout the time that the system was used.

Example 2

In this Example, the same setup as in Example 1 above is used but the system is now given a water content setpoint that is significantly lower than the water content of the ambient air throughout the 24 hours that the system is run. Thus, the system will control the temperature but will only provide dehumidification of the air flow. The temperature setpoint was in this Example 20° C. and the water content setpoint was a relative humidity of 50%.

Simulation results using an MPC regulator and real weather conditions for Uppsala, Sweden are shown in FIG. 8. Very similar results were achieved in a second simulation performed using PID regulators.

It is especially to be noted that the water content of the air flow after passing through the contact device is maintained at or near the water content setpoint, even during the variations in water content of ambient air (shown in the curve System intake relative humidity) in the interval from 8 hours to 13 hours. At the same time, the variations in temperature of ambient air (shown in the curve System intake temperature) are handled by the system so that the temperature of the output air that has passed through the contact device quickly returns to the temperature setpoint.

Example 3

In this Example, the system and method of the present invention are compared with a prior art system and method for controlling temperature and dehumidifying air in a building.

The building comprises an office space of 517 $m^2$ and it is situated in a hot and humid location where dehumidification and temperature control of indoor air is required. The office space is in use 7-17 on Monday-Friday all year round. Selected setpoint for temperature, $T_{set}$, is 16° C. and selected setpoint for water content, $wc_{set}$, is a relative humidity of 60%.

The maximum airflow in the office space is 1300 l/s and there is an air distribution system that provides air circulation indoors. The air distribution system is a VAV (variable air volume) system.

In the prior art system, dehumidifying is provided by using a cooling coil to cause condensation of humidity in the air so that air is removed in the form of condensate. In a second step, the air is reheated in a heating battery before being released into the office space. The prior art system used in this example is a conventional system that is in general use, such as an air handling unit with cooling and heating.

The inventive system comprises a contact device that in this Example is realised as an evaporative pad in the form of a CeLPad 0760. The first control device had a buffer of 2 $m^3$, in which the water content could be increased by injecting water directly into the buffer and the water content was decreased by regenerating the medium. Since the setpoint for water content was lower than a typical water content of air in the location where the office building was located, the medium was regenerated during use of the system but no additional water was added to the buffer. The second control device is realised as a plate heat exchanger The medium was potassium acetate. The processing circuitry was in this Example in the form of an LQR regulator.

The prior art system was used for 365 consecutive days, i.e. a full year, and the inventive system was also used for the same number of days. External factors such as ambient temperature and ambient humidity did not differ significantly during this time. Energy consumption was measured and results are presented in Table 1 below.

TABLE 1

| | Prior art system | | Inventive system | |
|---|---|---|---|---|
| | kWh | kWh/$m^2$ | kWh | kWh/$m^2$ |
| Fans, pumps | 7444 | 14.4 | 6493 | 12.6 |
| Compressor | 82681 | 160.0 | 62413 | 120.8 |
| Total electricty, facility | 90125 | 174.4 | 68906 | 133.4 |
| Saving | | | | 23% |

TABLE 1-continued

| | Prior art system | | Inventive system | |
|---|---|---|---|---|
| | kWh | kWh/$m^2$ | kWh | kWh/$m^2$ |
| Equipment | 6086 | 11.8 | 6086 | 11.8 |
| Lighting | 8116 | 15.7 | 8116 | 15.7 |
| Total electricty, tenant | 14202 | 27.5 | 14202 | 27.5 |

As can be seen, using the inventive system caused a significant lowering of the energy consumption in the office building. It was also noted that these results could be achieved while allowing a higher supply temperature, i.e. a higher temperature of cooling water supplied to the second control device.

Other features such as the flow of air through the systems, the temperature of the airflow upstream of the system and temperature downstream of the system, i.e. the return temperature after contact with the medium in the system, were the same for the prior art system and the inventive system. Also, the water content downstream of the systems were the same. To conclude, the inventive system was able to achieve the same results as the prior art system but using significantly less energy due to the fact that water content and temperature of the air flow could be adjusted using the inventive method.

Further Embodiments

In one or more embodiment, there is provided a non-transitory computer-readable storage medium storing instructions which, when executed by processing circuitry 40 of the system 1, cause the system 1 to perform the method as defined in any of the method disclosed herein (in other words, in the claims, the summary, or the detailed description).

The non-transitory computer-readable storage medium may store instructions which, when executed by processing circuitry 40 of the system 1, cause the system 1 to: receive the first input signal, the second input signal, the third input signal and the fourth input signal, determine the desired temperature change, $T_{change}$, and desired water content change, $wc_{change}$, of the medium as a first function $f_1$, and generate the first control signal, $C_1$, and the second control signal, $C_2$.

The non-transitory computer-readable storage medium may further store instruction which, when executed by processing circuitry 40 of the system 1 for controlling temperature and water content of an air stream, cause the system 1 to perform the method steps of any of the embodiments presented in connection with FIGS. 4-5.

It is to be noted that features from the various embodiments described herein may freely be combined, unless it is explicitly stated that such a combination would be unsuitable.

The invention claimed is:

1. System for controlling temperature and water content of an air stream, the system (1) comprising a contact device (10) that transfers thermal energy and water vapor between a medium and an air stream flowing through the contact device, the contact device (10) allowing contact between the medium and the air stream in which thermal energy and water vapor is transferred, a first control device (20) that controls water content of the medium, a second control device (30) that controls temperature of the medium, wherein the contact device (10), the first control device (20) and the second control device (30) are connected such that the medium is able to flow in a loop (50) comprising the contact device (10), the first control device (20), and the second control device (30), processing circuitry (40) configured to control the first control device (20) and the second control device (30), a first sensor (S1) configured to measure a medium water content parameter, $wc_{medium}$, of the medium and to send signals indicative of the medium water content parameter to the processing circuitry, said medium water content parameter being a parameter indicative of an amount of water in the medium, a second sensor (S2) configured to measure a medium temperature of the medium, $T_{medium}$, and to send signals indicative of the temperature to the processing circuitry, a third sensor (S3) configured to measure an air temperature of the air stream, $T_{air}$, and to send signals indicative of the temperature to the processing circuitry, and a fourth sensor (S4) configured to measure an air water content parameter, $wc_{air}$, of the air stream and to send signals indicative of the air water content parameter to the processing circuitry, said air water content parameter being a parameter indicative of an amount of water in the air stream, wherein said third sensor and said fourth sensor are configured to measure air temperature and air water content in a downstream section, said downstream section being a section that the air stream passes after flowing through the contact device, wherein the processing circuitry (40) is configured to control air temperature and air water content of the air stream passing through the contact device by receiving, from the first sensor, a first input signal comprising the medium water content parameter, $wc_{medium}$, receiving, from the second sensor, a second input signal comprising the measured medium temperature, $T_{medium}$, receiving, from the third sensor, a third input signal, comprising the measured air temperature, $T_{air}$, receiving, from the fourth sensor, a fourth input signal comprising the measured air water content parameter, $wc_{air}$, and determining, based on the received first, second, third and fourth input signals, a desired temperature change, $T_{change}$, and desired water content change, $wc_{change}$ of the medium as a first function $f_1$:

$$(T_{change}, wc_{change}) = f_1(T_{medium}, wc_{medium}, T_{air}, wc_{air}, f_2(T_{air}, wc_{air})),$$

wherein the second function $f_2$ ($T_{air}$, $wc_{air}$) defines a relationship between the air temperature, $T_{air}$, and the air water content parameter, $wc_{air}$, as co-dependent variables such that a change in the value of one of the air temperature, $T_{air}$, and the air water content parameter, $wc_{air}$, affects the value of the other, and wherein the desired temperature change, $T_{change}$ and the desired water content change, $wc_{change}$ are determined such that the air stream flowing through the contact device approaches a predetermined temperature setpoint, $T_{set}$, and a predetermined water content setpoint, $wc_{set}$, through contact with the medium in the contact device, generating a first control signal which is configured to cause the first control device to apply the water content change, $wc_{change}$, to the medium such that the medium water content changes from the value of the medium water content parameter, $wc_{medium}$, by the desired water content change, $wc_{change}$, and generating a second control signal which is configured to cause the second control device to apply the temperature change, $T_{change}$ to the medium such that the medium temperature changes from the measured medium temperature, $T_{medium}$, by the desired temperature change, $T_{change}$.

2. System according to claim 1, wherein the processing circuitry is further configured to repeatedly receive the first input signal, the second input signal, the third input signal and the fourth input signal, update the first function $f_1$, and update the first control signal and second control signal based on said updated first function $f_1$.

3. System according to claim 1, wherein the system (1) is further configured to transmit the first control signal to the first control device (20) and change a medium water content in the first control device (20) in response to said first control signal.

4. System according to claim 1, wherein the system (1) is further configured to transmit the second control signal to the second control device (30) and change the medium temperature in the second control device (30) in response to the second control signal.

5. System according to claim 1, further comprising a fifth sensor (S5) configured to measure an upstream air temperature of the air stream, $T_{upstream}$, and send signals indicative of the upstream air temperature to the processing circuitry, and a sixth sensor (S6) configured to measure an upstream air water content parameter, $wc_{upstream}$, of the air stream and send signals indicative of the upstream air water content parameter to the processing circuitry, said upstream air water content parameter being a parameter indicative of an amount of water in the air stream, wherein said fifth sensor and said sixth sensor are configured to measure upstream air temperature and upstream air water content in an upstream section, said upstream section being a section the air stream passes before flowing through the contact device, and the processing circuitry is further configured to receive, from the fifth sensor, a fifth input signal, comprising the measured upstream air temperature, $T_{upstream}$, receive, from the sixth sensor, a sixth input signal comprising the measured upstream air water content parameter, $wc_{upstream}$, and determine the first function $f_1$:

$$T_{change}, wc_{change}) = f_1(T_{medium}, wc_{medium}, T_{air}, wc_{air}, f_2(T_{air}, wc_{air}), T_{upstream}, wc_{upstream}).$$

6. System according to claim 1, wherein the processing circuitry (40) is further configured to determine the first function $f_1$, based on the received first, second, third and fourth input signals and also on at least one contact device parameter, cd, of the contact device, as:

$$(T_{change}, wc_{change}) = f_1(T_{medium}, wc_{medium}, T_{air}, wc_{air}, f_2(T_{air}, wc_{air}), cd).$$

7. System according to claim 6, wherein the at least one contact device parameter, cd, is a mass flow of the air stream or of the medium through the contact device, or a back pressure.

8. System according to claim 1, wherein the first control device (20) comprises a buffer (B) comprising a volume of the medium, and wherein changing the medium water content comprises adding water to the buffer and/or removing water from the buffer by regenerating a portion of the volume.

9. System according to claim 1, further comprising at least one additional sensor (S7) configured to measure the medium temperature of the medium, $T_{medium}$, or the medium water content parameter of the medium, $wc_{medium}$, wherein the additional sensor is configured to measure the medium temperature, $T_{medium}$, or the medium water content parameter of the medium, $wc_{medium}$, in another part of the loop than the first sensor or the second sensor.

10. Computer implemented method for controlling temperature and humidity of an air stream in a system comprising a contact device that transfers thermal energy and water vapor between a medium and an air stream flowing through the contact device, the contact device allowing contact between the medium and the air stream in which thermal energy and water vapor is transferred;

a first control device that controls water content of the medium;

a second control device that controls temperature of the medium; and processing circuitry configured to control the first control device and the second control device, wherein the contact device, the first control device and the second control device are connected such that the medium is able to flow in a loop comprising the contact device, the first control device, and the second control device, the method comprising:

receiving, in the processing circuitry, a first input signal from a first sensor, said first input signal comprising a measured medium water content parameter, $wc_{medium}$, indicative of the water content of a medium, receiving, in the processing circuitry, a second input signal from a second sensor, said second input signal comprising a measured medium temperature, $T_{medium}$, indicative of the temperature of the medium, receiving, in the processing circuitry, a third input signal from a third sensor, said third input signal comprising a measured air temperature, $T_{air}$, indicative of a temperature of the air stream in a downstream section of the system, said downstream section being a section that the air stream passes after flowing through the contact device, receiving, in the processing circuitry, a fourth input signal from a fourth sensor, said fourth input signal comprising a measured air water content parameter $wc_{air}$, indicative of an amount of water in the air stream in the downstream section of the system, determining, using the processing circuitry, based on the first, second, third and fourth signals, a desired temperature change, $T_{change}$, and desired water content change, $wc_{change}$, of the medium as a first function $f_1$:

$$(T_{change}, wc_{change}) = f_1(T_{medium}, wc_{medium}, T_{air}, wc_{air}, f_2(T_{air}, wc_{air})),$$

wherein the second function $f_2$ ($T_{air}$, $wc_{air}$) defines a relationship between the air temperature, $T_{air}$, and the air water content parameter, $wc_{air}$, as co-dependent variables, such that a change in the value of one of the air temperature, $T_{air}$, and the air water content parameter, $wc_{air}$, affects the value of the other, and the desired temperature change, $T_{change}$ and the desired water content change, $wc_{change}$ are determined such that the air stream flowing through a contact device approaches a predetermined temperature setpoint, $T_{set}$, and a predetermined water content setpoint, $wc_{set}$, through contact with the medium in the contact device, generating, using the processing circuitry, a first control signal, $C_1$, which is configured to cause the first control device to apply the water content change, $wc_{change}$, to the medium such that the medium water content changes from the value of the medium water content parameter, $wc_{medium}$, by the desired water content change, $wc_{change}$, and generating, using the processing circuitry, a second control signal, $C_2$, which is configured to cause the second control device to apply the temperature change, $T_{change}$ to the medium such that the medium temperature changes from the measured medium temperature, $T_{medium}$, by the desired temperature change, $T_{change}$.

11. Method according to claim 10, further comprising repeatedly receiving, in processing circuitry, the first input signal, the second input signal, the third input signal and the fourth input signal, updating, using processing circuitry, the first function $f_1$, and updating, using processing circuitry, the first control signal and second control signal based on said updated first function $f_1$.

12. Method according to claim 10, further comprising transmitting the first control signal to a first control device, said first control device being configured to change the medium water content of the medium, and changing the medium water content in response to said first control signal.

13. Method according to claim 10, further comprising transmitting the second control signal to a second control device, said second control device being configured to change the medium temperature of the medium, and changing the medium temperature in response to said second control signal.

14. Method according to claim 10, further comprising receiving, in processing circuitry, a fifth input signal from a fifth sensor configured to measure an upstream air temperature of the air stream, $T_{upstream}$, said fifth input signal comprising the measured upstream air temperature, $T_{upstream}$, receiving, in processing circuitry, a sixth input signal from a sixth sensor configured to measure an upstream air water content parameter, $wc_{upstream}$, of the air stream, said sixth input signal comprising the measured upstream air water content parameter, $wc_{upstream}$, and determining the first function $f_1$ based on the received parameters as $$(T_{change}, wc_{change}) = f_1(T_{medium}, wc_{medium}, T_{air}, wc_{air}, f_2(T_{air}, wc_{air}), T_{upstream}, wc_{upstream}).$$

15. Method according to claim 10, further comprising determining the first function $f_1$ based on the received first, second, third and fourth input signals and on at least one predetermined contact device parameter, cd, of a contact device, as $$(T_{change}, wc_{change}) = f_1(T_{medium}, wc_{medium}, T_{air}, wc_{air}, f_2(T_{air}, wc_{air}), cd).$$

* * * * *